United States Patent [19]

Funk

[11] Patent Number: 4,477,259

[45] **Date of Patent: * Oct. 16, 1984**

[54] GRINDING MIXTURE AND PROCESS FOR PREPARING A SLURRY THEREFROM

[75] Inventor: James E. Funk, Alfred Station, N.Y.

[73] Assignee: Alfred University Research Foundation, Inc., Alfred, N.Y.

[ * ] Notice: The portion of the term of this patent subsequent to Apr. 10, 2001 has been disclaimed.

[21] Appl. No.: 468,459

[22] Filed: Feb. 22, 1983

Related U.S. Application Data

[63] Continuation-in-part of Ser. No. 375,183, May 5, 1982, Pat. No. 4,441,887, which is a continuation-in-part of Ser. No. 288,737, Jul. 31, 1981, Pat. No. 4,416,666, which is a continuation-in-part of Ser. No. 88,815, Oct. 26, 1979, Pat. No. 4,282,006, which is a continuation-in-part of Ser. No. 957,166, Nov. 2, 1978, abandoned, which is a continuation-in-part of Ser. No. 790,337, Apr. 25, 1977, abandoned.

[51] Int. Cl.[3] ..... C10L 1/32
[52] U.S. Cl. ..... 44/51
[58] Field of Search ..... 44/51; 241/16

[56] References Cited

U.S. PATENT DOCUMENTS 4,104,035 8/1978 Cole et al. ..... 44/51
4,282,006 4/1981 Funk ..... 44/51

*Primary Examiner*—Y. Harris-Smith
*Attorney, Agent, or Firm*—Howard J. Greenwald

[57] ABSTRACT

A novel grinding mixture useful for preparing a solid-liquid slurry is disclosed. This grinding mixture contains from about 60 to about 82 volume percent of carbonaceous material (such as coal and/or coke), from about 18 to about 40 volume percent of carrier liquid (such as, e.g., water and/or oil), and from about 0.01 to about 4.0 weight percent of dispersing agent. The grinding mixture has a pH of from about 7 to about 12. There are at least two consists in the grinding mixture. From about 2 to about 50 weight percent of the particles in the grinding mixture have a median particle size of from about 0.5 to about 40 microns. From about 50 to about 98 weight percent of the particles in the grinding mixture have a median particle size in excess of 40 microns.

There is also provided a process for preparing a liquid-solid slurry wherein the grinding mixture is ground until a slurry is produced whose particle size distribution is in accordance with a specified "CPFT" formula.

92 Claims, 2 Drawing Figures

GRINDING MIXTURE AND PROCESS FOR PREPARING A SLURRY THEREFROM

CROSS-REFERENCE TO RELATED APPLICATIONS

This application is a continuation-in-part of applicant's copending application Ser. No. 375,183 filed May 5, 1982 now U.S. Pat. No. 4,441,887 which was a continuation-in-part of application Ser. No. 288,737 filed July 31, 1981, now U.S. Pat. No. 4,416,666 which was a continuation-in-part of application Ser. No. 088,815 filed Oct. 26, 1979 (now U.S. Pat. No. 4,282,006), which was a continuation-in-part of application Ser. No. 957,166 filed Nov. 2, 1978 (now abandoned), which was a continuation-in-part of application Ser. No. 790,337 filed Apr. 25, 1977 (now abandoned).

TECHNICAL FIELD

A novel grinding mixture which can be used to prepare a stable, low viscosity slurry is disclosed. Also disclosed is a process of grinding said grinding mixture to produce said slurry.

BACKGROUND OF THE INVENTION

Coal-water slurries are well known to those skilled in the art. Some of them have a high solids content and can be burned directly without being dewatered. Some of them have a low viscosity and can be readily pumped through pipelines. Some of them require a substantial amount of energy to prepare. Some of them are stable and can be stored for long periods of time in a quiescent state before being burned. However, there are no prior art coal-water slurries known to applicant which combine the properties of high solids content, low viscosity, and stability.

The prior art teaches that high density coal-water slurries have high viscosities and are substantially unpumpable. Thus, as is taught in U.S. Pat. No. 4,052,169 of Cole et al., a coal-water slurry containing more than 60 weight percent of coal is " . . . difficult to pump" (lines 40–44 of Column 2). Thus, U.S. Pat. No. 4,104,035 of Cole et al., teaches that "As the solids content increases above this range the slurry becomes increasingly difficult to pump and at about 50% solids content it is unpumpable" (lines 30–33 of Column 1).

U.S. Pat. No. 4,242,098 teaches that, in general, coal-water slurries containing more than about 50 weight percent of coal are unstable, stating that "Aqueous slurries of finely ground coal containing more than about 55 weight percent solids are difficult to transport using conventional slurry pumps because as the solids level is increased above about 50 weight percent the water and solids tend to separate causing coal particles to build up in various areas throughout the pumping system" (Column 1, lines 15–21).

U.S. Pat. No. 3,762,887 discloses a coal-water slurry containing 54–69 volume percent of coal and 46–31 volume percent of water. The coal particles in the slurry have a specified particle size distribution such that substantially all of the particles pass through a 4 mesh Tyler Standard Screen and between 18 and 33 percent pass through a 325 mesh (44 microns) Tyler Standard Screen. The patentees teach that the viscosity of their slurry " . . . is in the range of that of hot Bunker C fuel oil" (Column 3, lines 13–14).

It is an object of this invention to provide a grinding mixture which can be used to prepare a high density, stable, carbonaceous solids-liquid slurry which has relatively low viscosity. It is yet another object of this invention to provide a process for the preparation of said slurry.

SUMMARY OF THE INVENTION

A novel grinding mixture which can be used to prepare a stable, low viscosity slurry is disclosed. The grinding mixture has a pH of 5–12 and contains from about 60–82 volume percent of solid carbonaceous material, from about 18–40 volume percent of carrier liquid, and from about 0.01 to about 4.0 weight percent of dispersing agent. The solid carbonaceous material in the grinding mixture contains fine carbonaceous material and coarse carbonaceous material. From about 2 to about 50 weight of said solid carbonaceous material in the grinding mixture is comprised of fine carbonaceous material(s) which has a median particle size of from about 0.5 to about 40 microns. From about 50 to about 98 weight percent of the total amount of said solid material is comprised of coarse carbonaceous material whose median particle size is greater than about 40 microns.

A process for preparing a stable, low viscosity slurry is also disclosed. In said process, the aforementioned grinding mixture is ground until a slurry is produced which contains a specified particle size distribution, contains at least 5 weight percent of colloidal carbonaceous particles, has a yield stress of from about 3 to about 18 Pascals, and is comprised of a consist which has a porosity of less than 20 volume percent and a specific surface area of 0.8 to 4.0 square meters per cubic centimeter. The slurry so produced contains at least 60 volume percent of carbonaceous solids and preferably has a specified interrelationship between its solids content, the porosity of said consist, the specific surface area of said consist, and the zeta potential of the colloidal carbonaceous particles in the consist.

BRIEF DESCRIPTION OF THE DRAWINGS

The present invention will be more fully understood by reference to the following detailed description thereof, when read in conjunction with the attached drawings, wherein like reference numerals refer to like elements and wherein.

DETAILED DESCRIPTION OF THE INVENTION

Figure 1:
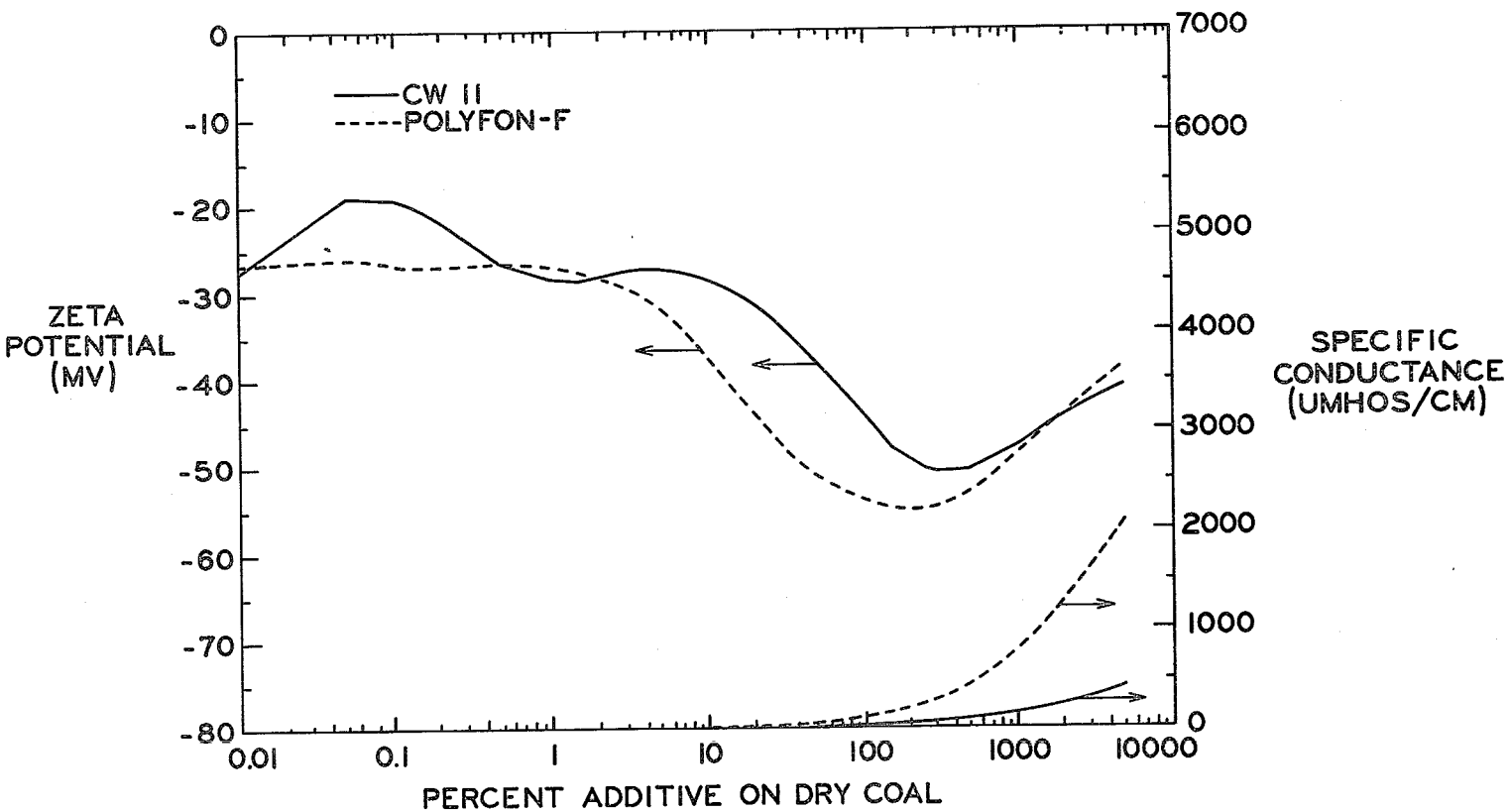
FIG. 1 is a chart showing the correlation between the zeta potential of coal particles in a fluid and the specific conductance of the fluid as a function of percent dispersing agent added to the fluid for two candidate dispersants.

The slurry produced by the process of this invention preferably has both static and dynamic stability; it is preferably capable of maintaining its level of homogeneity over an extended period of time, and its physical state preferably neither readily changes nor undergoes fluctuations which substantially impair its use.

In one aspect of this invention, a grinding mixture is provided. This grinding mixture contains from about 60 to about 82 parts by volume of carbonaceous material, from about 18 to about 40 parts by volume of carrier liquid, and from about 0.01 to about 4.0 parts, by weight of dry carbonaceous material, of dispersing agent; the pH of this grinding mixture is from about 5 to about 12.

The grinding mixture used in this invention can be provided either prior to or during grinding. In one embodiment, the carbonaceous material, carrier liquid, and dispersant are mixed to provide the grinding mixture, and the mixture so provided is then ground to produce a stable slurry. The aforementioned materials can be mixed by means well known to those skilled in the art including, e.g., blending them together, grinding them together, and combinations of blending and grinding them together. In another embodiment, all of the carbonaceous material desired in the grinding mixture is mixed with less than all of the carrier liquid and/or dispersant desired in the grinding mixture, and the incomplete mixture is then ground while the remainder of the carrier liquid and/or the dispersant is added during grinding; in this embodiment, the desired grinding mixture is generated in situ during grinding. In another embodiment, less than all of the carbonaceous material desired in the grinding mixture is mixed with carrier liquid and dispersant, and the incomplete mixture is then ground while the remainder of the carbonaceous material is added during grinding; in this embodiment, the desired grinding mixture is also generated in situ during grinding. Other embodiments will be apparent to those skilled in the art. Any embodiment wherein the specified grinding mixture is present and is ground to produce the specified slurry described herein is within the scope of applicant's invention.

As used in this specification, the terms "mixed" and "mixing" refer to the steps of combining or blending several masses into one mass and includes, e.g., blending, grinding, milling, and all other steps by which two or more masses are brought into contact with each other and combined to some extent. Conventional means for mixing viscous materials can be used in the process of this invention. Thus, by way of illustration and not limitation, one can use batch mixers such as change-can mixers, stationary tank mixers, gate mixers, shear-bar mixers, helical blade mixers, double-arm kneading mixers, screw-discharge batch mixers, intensive mixers, roll mills, bulk blenders, Littleford-Lodige mixers, cone and screw mixers, pan muller mixers, and the like; one can use continuous mixers such as single-screw extruders, the Rietz extruder, the Baker Perkins Ko-Kneader, the Transfer-Mix, the Baker Perkins Rotofeed, twin-screw continuous mixers, trough and screw mixers, pug mills, the Kneadermaster, and the like.

In the process of this invention, a mixture comprising from about 60 to about 82 volume percent of one or more solid carbonaceous materials (such as, e.g., coke and/or coal) and one or more carrier liquids (such as, e.g., water and/or oil) is ground until a slurry with specified properties is obtained. Said carbonaceous material/carrier liquid mixture is hereinafter referred to in this specification as the "grinding mixture".

The grinding mixture used in the process of this invention is preferably comprised of at least one carbonaceous solid material. As used in this specification, the term "carbonaceous" refers to a carbon-containing material and includes, by way of illustration and not limitation, coal, coke, graphite, charcoal, char, and the like. The preferred carbonaceous materials are carbonaceous fuels.

In one preferred embodiment, the carbonaceous solid is coal. By way of illustration, anthracite, semi-anthracite, medium, and high-volatile bituminous, sub-bituminous and lignite coals may advantageously be used to practice the invention.

The coal for use in the process can be obtained in a dry or wet form and mixed with fluid to form a coal-fluid mixture. Preferably, the coal for making a fine particle sized fraction is wet milled in known ways to prevent dust and explosion hazards, while optionally adding dispersing agent(s) to the fluid. The wet milled coal fraction can be milled with all of the water, or it can be mixed with sufficient additional water to make a slurry when it is further mixed with a coarser crushed coal fraction.

In view of the manner in which coal fractures during milling, coal particles will have irregular shapes which, however, are of a body (or maximum side-to-side thickness) such that the sub-sieve sized discrete particles will pass through a specified mesh of a sieve. The size of the discrete particle can be expressed in terms of a spherical diameter which, as used herein, is defined as a U.S. sieve size of from 4 mesh to 400 mesh (38 $\mu$m) through which a coal particle from a sample of coal or coal-water slurry will pass. For particles finer than 200 mesh (74 $\mu$m), the size of the particles can be determined by means of a sieve, or a sedimentometer, scanning electron microscope (SEM), or the like.

In one preferred embodiment, the carbonaceous solid material is coke. Coke is the solid, cellular, infusible material remaining after the carbonization of coal, pitch, petroleum residues, and certain other carbonaceous materials. The varieties of coke, other than those from coal, generally are identified by prefixing a word to indicate the source, e.g., "petroleum coke". To indicate the process by which a coke is manufactured, a prefix also is often used, e.g., "beehive coke".

High temperature coke can be used in this invention. As is known to those skilled in the art, this coke can be prepared from bituminous coal. Most of this type of coke is made in slot-type recovery ovens. In general, this type of coke contains from about 0.6 to about 1.4 weight percent of volatile matter and has an apparent specific gravity of from about 0.8 to about 0.99.

Foundry coke can also be used in this invention. In general, the volatile matter in this type of coke is less than about 2 weight percent.

Low temperature coke and medium temperature coke can also be used in this invention.

Pitch coke can be used in this invention. Pitch coke is made from coal-tar pitch; it has about 1.0 percent volatile matter, and it generally contains less than 0.5 percent sulfur.

Petroleum coke can be used in this invention. There are at least two types of petroleum coke: delayed coke and fluid coke. Delayed coke generally contains from about 8 to about 18 weight percent volatile matter, has a grindability index of from about 40 to about 60, and has a true density of from about 1.28 to about 1.42 grams per milliliter. Fluid coke generally contains from about 3.7 to about 7.0 weight percent of volatile matter, has a grindability index of from about 20 to about 30, and has a true density of from about 1.5 to about 1.6 grams per milliliter.

In another preferred embodiment, the carbonaceous solid material is char. Char is the non-agglomerated, non-fusible residue from the thermal treatment of solid carbonaceous materials. Coal char is obtained as a residue or a coproduct from low-temperature carbonization processes; such a char typically contains from about 1 to about 5 weight percent of volatile matter.

In another preferred embodiment, the carbonaceous material is charcoal. Charcoal is the residue remaining after the destructive distillation of wood.

In yet another embodiment, the carbonaceous material is solvent refined coal.

In general, any carbonaceous fuel can be used as the solid carbonaceous material in this invention.

Mixtures of carbonaceous solids also can be used. By way of illustration and not limitation, one can use a mixture of at least one coarse carbonaceous fraction which contains less than about 30 weight percent of volatilizable hydrocarbons (such as, e.g., anthracite or low volatile bituminous coal) and at least one fine carbonaceous fraction which contains more than about 35 weight percent of volatilizable hydrocarbons (such as, e.g., lignite or high volatile bituminous coal). One can use a mixture of two or more of said coarse carbonaceous fractions and one of said fine fractions, one of said coarse carbonaceous fractions and two or more of said fine fractions, or two or more of said coarse carbonaceous fractions and two or more of said fine fractions. In this embodiment, the grinding mixture is preferably comprised of from about 2 to about 50 weight percent of solid carbonaceous material which has a median particle size of from about 0.5 to about 40 microns and from about 50 to about 98 weight percent of solid carbonaceous material which has a median particle size in excess of 40 microns.

In one embodiment of this invention, the grinding mixture of this invention is comprised of at least two consists of carbonaceous material. As used in this specification, and in the prior art, the term "consist" means the particle size distribution of the solid phase of the carbonaceous material/fluid slurry. For example, in the prior art, the term "8 mesh×0", when used with reference to a coal-water slurry, indicates coal with a graded size, or consist, of coal particles distributed in the range of 8 mesh and zero, or 2360 microns×zero microns. Similarly, the term "about 1180 microns×0.05 microns" indicates coal with a nominally measurable graded size, or "consist", of coal particles distributed in the range of from about 1180 microns to a measurable colloidal size, e.g., at least about 0.05 microns. The term "about 1180 microns" is nominally equivalent to a U.S. Series 16 mesh sieve, substantially as defined in "Handbook of Chemistry and Physics", 54th Edition, 1973–1974, CRC Press, Cleveland, Ohio, page 143, "Standard Test Sieves (wire cloth)", the disclosure of which is hereby incorporated by reference into this specification. Unless otherwise stated in this specification, the weight of carbonaceous material is on a moisture-free or "dry basis" herein. Thus, e.g., the "solids" in as-mined carbonaceous material include, e.g., carbonaceous material and ash. Thus, there is a considerable amount of bound water in coal as mined; the volume of this water in the coal is not included in the solids weight in order to calculate the volume percent of "dry solids" in the grinding mixture used in the process of this invention. Thus, as used herein, the term "dry basis" refers to coal (and/or other carbonaceous material) which is substantially free of carrier liquid. Carbonaceous material is considered to be dry after it has been air dried by being exposed to air at a temperature of at least 70 degrees Fahrenheit and a relative humidity of less than 50 percent for at least 24 hours.

In a preferred embodiment of this invention, at least two consists of carbonaceous material are mixed with carrier fluid to prepare the grinding mixture. Both of said consists of carbonaceous material can be produced by wet grinding; thus, e.g., one of the consists can be produced by grinding coal at a high solids content (60–82 volume percent) in the presence of water and optionally, surfactant, the second of the consists can be produced by grinding coal at a lower solids content (30–60 volume percent) in a ball mill or a stirred ball mill, and the first and the second coal consists can be ground together with each other (and, optionally, with one or more additional consists produced by wet and/or dry grinding) at a solids content of from about 60 to about 82 volume percent in the optional presence of from about 0.01 to about 4.0 weight percent of dispersant and water. Alternatively, both of said consists of carbonaceous material can be produced by dry grinding; thus, e.g., one of the consists can be prepared by grinding one pulverized coal (i.e., coal which has been milled or ground to a consist of about 20 mesh by 0) in, e.g., a ring roller mill, a second or more of the consists can be prepared by dry grinding a second pulverized coal in, e.g., a micronizer fluid energy (jet) mill, and the two ground dry fractions are then blended in a blending tank at a solids concentration of from 60–82 volume percent with water and, optionally, 0.01 to 4.0 weight percent of dispersant at a high shear stress in a mixer such as a Greerco in-line mixer.

Alternatively, at least one of said consists can be produced by wet grinding and at least one of said consists can be produced by dry grinding; thus, e.g., one of the consists can be produced by wet grinding coal at a low solids content (30–60 volume percent) in the presence of water and, optionally, dispersant, a second of the consists can be produced by dry grinding pulverized coal in either a micronizer fluid energy (jet) mill, or a ring roller mill, and the consists produced by wet and dry grinding are then blended in a blending tank at a solids concentration of 60–82 volume percent water and, optionally, 0.01 to 4.0 weight percent of dispersant at a high shear stress in a mixer such as a Greerco in-line mixer.

Alternatively, one can prepare the grinding mixture of this invention by wet grinding (or regrinding) slurry comprised of carbonaceous material to produce the fine consist for the mixture. Thus, by way of illustration, a fine consist can be prepared by regrinding a "final slurry" product at a concentration of from about 40 to about 60 weight percent solids (and preferably at from about 45 to about 55 weight percent of solids) in, e.g., a stirred ball mill until the median particle size of the carbonaceous particles in the slurry is from about 4 to about 20 microns. The coarse consist can be produced by dry crushing (in, e.g., a roll crusher, a gyratory crusher, a cage mill, etc.) the carbonaceous material to a nominal $\frac{3}{8}''\times 0$ size so that the median particle size of the coarse fraction exceeds 40 microns. The coarse and fine fractions can then be combined with each other, carrier liquid, and dispersing agent to produce a grinding mixture comprised of from about 60 to about 82 volume percent of carbonaceous material, from about 18 to about 40 volume percent of carrier liquid, and from about 0.01 to about 4.0 weight percent of dispersion dispersing agent.

The fine consist in this particular embodiment can alternatively be made by regrinding a dry pulverized coal at a concentration of from about 40 to about 60 weight percent solids until the median particle size of the fine consist is from about 4 to about 20 microns.

Figure 2:
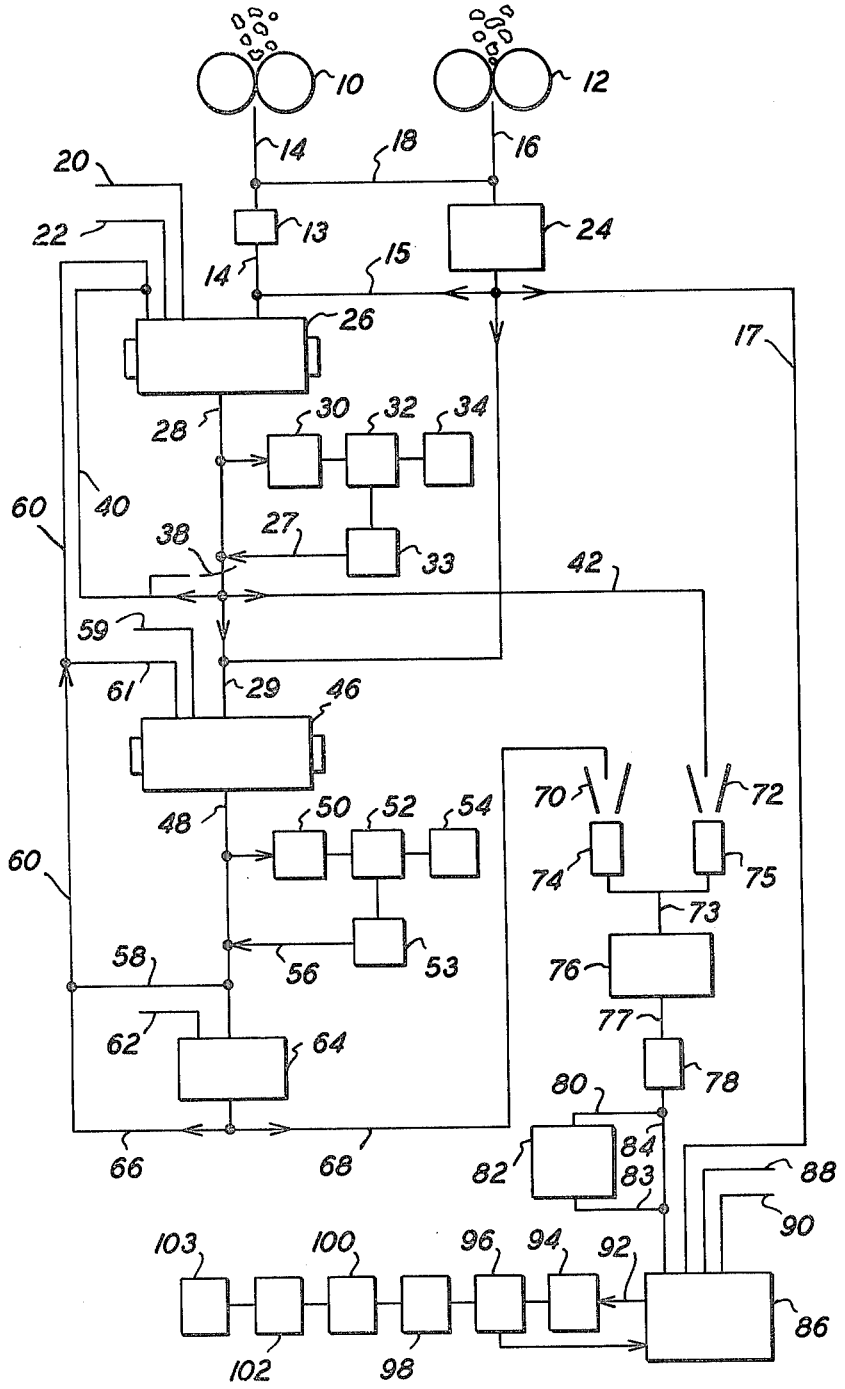
FIG. 2 is a flow sheet of a preferred grinding process for preparing the stable slurry described in this specification.

The aforementioned processes are all illustrated in FIG. 2.

It will be apparent to those skilled in the art that there are many other arrangements wherein two consists of carbonaceous material can be mixed with carrier liquid to produce the grinding mixture of this invention; they are intended to be within the scope of the invention.

The solid carbonaceous material in the grinding mixture of this invention consists essentially of at least one fine solid carbonaceous material and at least one coarse solid carbonaceous material. From about 2 to about 50 weight percent of the solid carbonaceous material in the grinding mixture is comprised of fine solid carbonaceous material with a median particle size of from about 0.5 to about 40 microns; it is preferred that from about 4 to about 40 weight percent of the solid carbonaceous material in the grinding mixture be comprised of fine solid carbonaceous material with a median particle size of from about 1 to about 30 microns; and it is even more preferred that from about 6 to about 30 weight percent of the solid carbonaceous material in the grinding mixture be comprised of fine solid carbonaceous material with a median particle size of from about 2 to about 20 microns. From about 50 to about 98 weight percent of the solid carbonaceous material in the grinding mixture is comprised of coarse solid carbonaceous material with a median particle size greater than 40 microns.

The grinding mixture can contain one fine carbonaceous solid fraction or several fine carbonaceous solid fractions, which may be the same or different carbonaceous materials; regardless of whether one or several such fine fractions are present in the grinding mixture, from about 2 to about 50 weight percent of the solid carbonaceous material in the grinding mixture has a median particle size of from about 0.5 to about 40 microns.

The grinding mixture can contain one coarse carbonaceous solid fraction or several coarse carbonaceous solid fractions, which may be the same or different carbonaceous materials; regardless of whether one or several such coarse fractions are present in the grinding mixture, from about 50 to about 98 weight percent of the solid carbonaceous material in the grinding mixture has a median particle size greater than about 40 microns. It is preferred that the grinding mixture be comprised of from about 60 to about 96 weight percent of said coarse solid carbonaceous material, and it is more preferred that said grinding mixture be comprised of from about 70 to about 94 weight percent of said coarse solid carbonaceous material.

The grinding mixture can be comprised of discrete fine fraction(s) and coarse fraction(s) of solid carbonaceous material. Alternatively, the grinding mixture can be comprised of a single fraction of carbonaceous material, which was produced by mixing said coarse fraction(s) and said fine fraction(s). In either event, both grinding mixtures are within the scope of this invention. As long as a particle size analysis of the solid carbonaceous material in the grinding mixture reveals that from about 2 to about 50 weight percent of said material has a median particle size of from about 0.5 to about 40 microns, and that from about 2 to about 50 weight percent of said material has a median particle size greater than 40 microns, then the consists of carbonaceous material are suitable for use in the grinding mixture of this invention. The particle size analysis of the carbonaceous material will show substantial undulation at one or more points in the entire CPFT plot where two or more size distributions have obviously merged.

The carbonaceous solid is preferably mixed with from about 0.01 to about 4.0 weight percent (based upon dry weight of carbonaceous solid) of dispersing agent to produce said grinding mixture. In the case where at least two consists of carbonaceous solid material are mixed with liquid, (1) both of the consists can be dry ground and mixed with liquid and dispersant, (2) the dispersant can be mixed with the liquid, and the dry ground consists can be mixed with the liquid-dispersant mixture; (3) one of the consists can be dry ground, a second of the consists can be wet ground with part or all of the dispersant, and the ground consists can be mixed with the balance of the liquid and dispersant which was not theretofore mixed with the consists, or (4) some or all of the dispersant can be wet ground with one or both of the consists, and the ground consists can then be mixed with the liquid and the balance of the dispersant which was not theretofore mixed with the consists; (5) one or more consist can be wet ground with no dispersant and insufficient total water and then blended with dispersant and the balance of the water and/or other consist blends.

The grinding mixture used in the process of this invention contains from about 60 to about 82 volume percent of one or more carbonaceous solid materials. It is preferred that said grinding mixture contains from about 64 to about 81 volume percent of said carbonaceous solid material. In a more preferred embodiment, the grinding mixture contains from about 75 to about 80 volume percent of said solid carbonaceous material.

The grinding mixture used in the process of this invention generally has a pH of from about 5 to about 12. It is preferred that the pH of the grinding mixture be from about 7 to about 11.

The grinding mixture used in the process of this invention is comprised of one or more liquids. As used in this specification, the term liquid refers to a substance which undergoes continuous deformation under a shearing stress. The liquid used in the grinding mixture of this invention preferably performs at least two functions—it fills the interstitial pores of the carbonaceous solid material, and it provides the vehicle for separation of the particles of the carbonaceous solid material to minimize collisions between said particles; thus, the preferred liquid is a carrier liquid.

By way of illustration and not limitation, some of the liquids which can be used in the slurry of this invention include water; waste industrial solvents such as, e.g., effluents from waste disposal plants, contaminated waste water containing hydrocarbons from e.g., oil-separation processes, and the like; aromatic and aliphatic alcohols containing 1–10 carbon atoms, such as methanol, propanol, ethanol, butanol, phenol, mixtures thereof, and the like; pine oil; petroleum liquids such as, e.g., number 2 fuel oil, number 4 fuel oil, number 6 fuel oil, gasoline, naphtha, mixtures thereof, and the like; hydrocarbon solvents such as, e.g., benzene, toluene, xylene, kerosene, and derivatives thereof; acetone; aniline; anisole; halobenzenes such as; e.g., bromobenzene and chlorobenzene; nitrobenzene; carbon tetrachloride; chloroform; cyclohexane; n-decane; dodecane; 1,1,2,2-tetrachloroethane; ethyl bromide; 1,2-dichloroethylene; tetrachloroethylene; trichloroethylene; ethylene chloride, ethyl ether; ethyl iodide; glycol; n-hendecane; n-heptane; 1-heptanol; 1-hexanol; methylene halides such as, e.g., methylene chloride, methylene bromide, and methylene iodide; n-octadecane; n-octane; 1-octanol; n-pentadecane pentanol; and the like. The aforementioned list is merely illustrative, and those skilled in the art will recognize that many other liquids can be used.

In one preferred embodiment, the liquid used is carrier water. As used in this specification, the term "carrier water" means the bulk of free water dispersed between the carbonaceous particles and contiguous to the bound layers on the particles, and it is to be distinguished from bound water. The term "bound water" means water retained in the "bound water layer", as defined and illustrated in Kirk-Othmer, Encyclopedia of Chemical Technology, 2d Edition, Vol. 22, pages 90–97 (at p. 91). The term "bound water" also includes water contained within the pure structure of discrete particles.

When the liquid mixed with the carbonaceous solid is water or is comprised of from about 5 to about 99 weight percent of water, it is preferred that the temperature of the solids-liquid mixture be maintained at from ambient to about 99 degrees centigrade during mixing to insure that the water does not substantially vaporize.

When water is added to a carbonaceous powder comprised of finely divided particles, and if the water "wets" the powder, a surface water film is adsorbed on each particle which is known to be structurally different from the surrounding "free" or bulk water, in that the film may be described as "semi-rigid", or "bound water film". Depending on the fundamental electrical potential of the surface, this "semi-rigid" or bound water film may be of several molecules thickness.

Mixtures of at least two liquids can be used in the grinding mixture of this invention. Thus, by way of illustration and not limitation, one may use mixtures of water and ethanol, water and petroleum liquids, and the like. One can use mixtures comprised of from about 1 to about 99 volume percent of alcohol and from about 99 to about 1 volume percent of water. In one preferred embodiment, the mixture is comprised of from about 1 to about 15 volume percent of alcohol with the remainder of the liquid consisting essentially of water. It is preferred that the alcohol be liquid and monohydric and that it contain from about 1 to about 10 carbon atoms. Suitable monohydric alcohols are listed on page 265 of Fieser and Fieser's "Advanced Organic Chemistry" (Reinhold, N.Y., 1961), the disclosure of which is hereby incorporated by reference into this specification.

In one preferred embodiment, the grinding mixture is comprised of at least about 60 volume percent of carbonaceous solid material and from about 18 to about 40 volume percent of carrier liquid. In one aspect of this embodiment, at least about 90 weight percent of the carrier liquid is water and less than about 10 weight percent of the carrier liquid is petroleum liquid. In this aspect, it is preferred that the petroleum liquid be selected from the group consisting of naphtha, high gas oil, low gas oil, catalytic cracked recycle oil, mixtures thereof, and other similar petroleum products. Vegetable oils such as corn, bean, or pine oil may also be used to replace part or all of the petroleum liquid.

The grinding mixture of this invention is comprised of from about 18 to about 40 volume percent of one or more carrier liquids. It is preferred that the grinding mixture contain from about 19 to about 36 volume percent of one or more carrier liquids. In the most preferred embodiment, the grinding mixture of this invention is comprised of from 20 to about 25 volume percent of one or more carrier liquids.

In addition of the aforementioned carbonaceous solids, carrier liquid(s), and dispersant, the grinding mixture used in the process of this invention also can contain from about 0 to about 10 volume percent of other additives sometimes present in coal-water slurries such as, e.g., inorganic electrolytes, etc.

The grinding mixture of this invention contains from about 0.01 to about 4.0 weight percent of dispersing agent, based upon the weight of dry carbonaceous solid material. The grinding mixture can contain the amount and type of dispersing agent which is most effective for it. Means for determining the identity and amount of the most effective dispersing agent for a given mixture will be described below for a coal-water mixture, it being understood that the technique described is applicable to other mixtures such as, e.g., coke-water, graphite-water, etc.

In general, for any given system, the identity of effective dispersing agents can be determined by measuring the effects of the dispersant upon the system at a given dispersant concentration; viscosity at constant shear rate of the stirred coal-water slurry is measured while titrating with increasing amounts of the dispersing agent, and the point at which the slurry viscosity ceases to decrease is noted. For any given dispersant(s), and system, the most effective concentration is the one which gives the minimum viscosity under a given set of test conditions, and the efficiency of different dispersants can be compared by testing them with a given system under comparable concentration and test conditions. Thus, for example, one can dry grind a sample of coal in a laboratory size ball mill with porcelain or steel balls in water at 50 weight percent solids, e.g., for 24 hours or until all of the particles in the coal are less than 10 microns in size; other grinding devices known to those skilled in the art may also be used such as vibroenergy mills, stirred ball mills, or fluid energy mills. Small samples (about 500 milliliters each) of the system can then be deflocculated by adding various dispersing agents to the samples dry or preferably in solution dropwise, blending the mixture at any consistent blending energy (which may be gentle as mixing by hand, or at very high shear energy which will improve dispersion), and then measuring the viscosity at some constant shear rate by, e.g., using a Brookfield RVT viscometer at 100 revolutions per minute. The dispersing agent (or combination of dispersing agents) which is found to produce the lowest viscosity for the system at a given shear rate and dispersing agent(s) concentration is the most effective for those conditions. This technique is described in detail in my U.S. Pat. No. 4,282,006, the disclosure of which is hereby incorporated herein by reference.

FIG. 1 illustrates one means of evaluating the effectiveness of surfactants for any given solid material. The curves of FIG. 1 represent data obtained using both a purported nonionic polymer CW-11 made by the Diamond Shamrock Process Chemicals Co. and an anionic lignosulfonate Polyfon-F made by Westvaco, Inc. adsorbed on an Australian coal. The fine coal ground to about 100% finer than 10 microns is slurried in distilled water at 0.01 weight percent solids. Aliquots are placed in test tubes and increasing amounts of any candidate surfactant is added to each test tube. The test tube samples are thoroughly mixed and inserted into a sampler carousel. The Pen Kem System 3000 Electrophoretic Mobility Analyzer automatically and sequentially samples each test tube and measures the electrophoretic mobility of the coal particles and the specific conductance of the carrier liquid. pH can also be measured on each sample. In FIG. 1 the left ordinate gives the calculated zeta potential of the particles in millivolts, the right ordinate gives the specific conductance in micromhos per square meter of the carrier liquid. These variables are both measured as a function of the percent addition of each surfactant on a dry coal basis which is plotted on the abscissa. FIG. 1 shows that the purported nonionic CW-11 surfactant does have some anionic character. This is probably due to the reorganization of the water structure at the water adsorbed surfactant interface. CW-11 has a zeta potential of −50 mv at 300% addition 0.01% dry coal. of the Polyfon-F at −55 mv zeta potential is greater than CW-11 at −50 mv. These data establish Polyfon-F as a relatively more chemically effective surfactant for use on this particular Australian coal. However, both are reasonably effective.

The amount of dispersing agents used will vary, depending upon such factors as the concentration of the carbonaceous material in the system, the particle size and particle size distribution, the amount of ash minerals (i.e. clays and other minerals present), the temperature of the system, the pH, the original zeta potential of the particles, and the identity of the dispersing agent(s) and its concentration. In general, the dispersing agent is present in the system at from 0.01 to 4.0 weight percent based on the weight of dry carbonaceous materials, and preferably from about 0.03 to about 1.8 weight percent. In an even more preferred embodiment, the slurry contains from about 0.05 to about 1.4 weight percent, by weight of dry solids, of dispersing agent. Procedurally, in determining the amount, measurements can be made of viscosities versus shear rates versus zeta potential for a series of solids-liquid mixtures containing a range of amounts of a particular dispersing agent for a constant amount of solids-liquid mixture. The data can be plotted and used as a guide to the optimum quantities of that agent to use to obtain minimum viscosity for that system.

Any dispersing agent which disperses the carbonaceous particles in the water can be used. As is known to those skilled in the art, the dispersing agent can be inorganic. Thus, for example, sodium hydroxide can be used with some carbonaceous materials. The dispersing agent can be, and preferably is, organic, i.e., it contains carbon. The dispersing agent is preferably an anionic organic surfactant.

It is preferred that the dispersing agent used be an organic compound which encompasses in the same molecule two dissimilar structural groups, e.g., a water soluble moiety, and a water insoluble moiety. It is preferred that said dispersing agent be a surfactant. The term "surface-active agent", or "surfactant", as used herein indicates any substance that alters energy relationships at interfaces, and, in particular, a synthetic or natural organic compound displaying surface activity including wetting agents, detergents, penetrants, spreaders, dispersing agents, foaming agents, etc.

The surfactant used is preferably an organic surfactant selected from the group consisting of anionic surfactants, non ionic surfactants, cationic surfactants, and amphoteric surfactants. It is preferred that the surfactant be either anionic or cationic. In the most preferred embodiment, the surfactant is anionic.

It is preferred that the molecular weight of the surfactant used be at least about 200. As used herein, the term "molecular weight" refers to the sum of the atomic weights of all the atoms in a molecule.

In one preferred embodiment, the surfactant is anionic and its solubilizing group(s) is selected from the group consisting of a carboxylate group, a sulfonate group, a sulfate group, a phosphate group, and mixtures thereof. By way of illustration, one of these preferred anionic surfactants is a polyacrylate having the general formula.

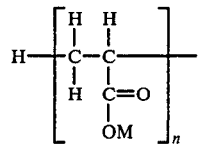

wherein n is a whole number of at least 3 and M is selected from the group consisting of hydrogen, sodium, potassium, and ammonium.

In another preferred embodiment, the surfactant is cationic and its solubilizing group(s) is selected from the group consisting of a primary amine group, a secondary amine group, a tertiary amine group, a quaternary ammonium group and mixtures thereof.

In yet another embodiment, the surfactant is amphoteric. In this embodiment, the surfactant has at least one solubilizing group selected from the group consisting of a carboxylate group, a sulfonate group, a sulfate group, a phosphate group, and mixtures thereof; and the surfactant also has at least one solubilizing group selected from the group consisting of a primary amine group, a secondary amine group, a tertiary amine group, a quaternary ammonium group, and mixtures thereof.

In one of the more preferred embodiments, the surfactant used is comprised of at least about 85 weight percent of a structural unit of the formula:

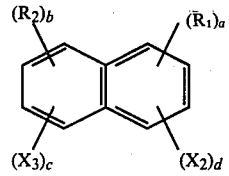

wherein $R_1$ and $R_2$ are independently selected from the group consisting of alkyl of from about 1 to about 6 carbon atoms and hydrogen; a, b, c, and d are integers independently selected from the group consisting of 0, 1, 2, 3, 4, 5, 6, 7, and 8, and $X_2$ and $X_3$ are independently selected from the group consisting of a carboxylate group, a sulfonate group, a sulfate group, a phosphate group, a nitro group, a halo group selected from the group consisting of chloro, bromo, fluoro, and iodo, —CN, an alkoxy group containing from 1 to about 6 carbon atoms, and a group of the formula $—R_3OR_4$ wherein $R_3$ and $R_4$ are an alkyl containing from about 1 to about 3 carbon atoms. The starting materials which can be used to prepare these surfactants are well known to those skilled in the art and include, e.g., naphthalene-α-sulfonic acid (dihydrate), naphthalene-β-sulfonic acid (monohydrate), α-nitronaphthalene, β-nitronaphthalene, α-naphthylamine, β-naphthylamine, α-naphthol, β-naphthol, α-naphthoic acid, β-naphthoic acid, α-chloronaphthalene, α-bromonaphthalene, β-bromonaphthalene, β-chloronaphthalene, α-naphthonitrile, β-naphthonitrile, 1,5-dinitronaphthalene, 1,8-dinitronaphthalene, β-methylnaphthalene, 1-nitro-2-methylnaphthalene, 2-methylnapthalene-6-sulfonic acid, 2,6-dimethylnaphthalene, β-6-methylnaphtholpropionic acid, 1,6-dibromo-2-naphthol, 6-bromo-2-naphthol, 1,6-dibromonapthalene, 6-bromo-2-naphthol, and the like. Again, it is preferred that at least one of the atoms in this surfactant be an alkali metal selected from the group consisting of sodium, potassium, ammonium, and mixtures thereof. One of the most preferred surfactants from this group is the alkali metal salt of a condensed mono maphthalene sulfonic acid. This acid, whose preparation is described in U.S. Pat. No. 3,067,243 (the disclosure of which is hereby incorporated by reference into this specification), can be prepared by sulfonating naphthalene with sulfuric acid, condensing the sulfonated naphthalene with formaldehyde, and then neutralizing the condensate so obtained with sodium hydroxide. This alkali or $NH_4+$ metal salt of a condensed mono naphthalene sulfonic acid is comprised of at least about 85 weight percent of a repeating structural unit of the formula

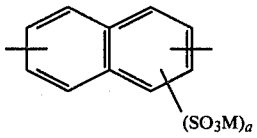

wherein M is an alkali metal selected from the group consisting of sodium, potassium, and ammonium and a is an integer of from 1 to 8. Comparable compounds with a benzene rather than napthalene nucleus also can be used.

Examples of anionic organic surfactants which have been found particularly advantageous are also described below. In some cases, mixtures of two or more of these surfactants beneficially can be used.

Some of the surfactants sold by the Diamond Shamrock Chemical Company of Morristown, N.J. can be used in this invention. Thus, by way of example, one can use surfactants such as Lomar D (the sodium salt of a condensed mono naphthalene sulfonic acid), Lomar PW (sodium neutralized naphthalene sulfonic acid), Lomar PWA (ammonia salt of a condensed mono naphthalene sulfonic acid), A23, Nopcosperse VFG (condensed alkyl naphthalene sulfonate), and Nopcosperse VEO (polymerized alkyl naphthalene sulfonate).

Some of the surfactants sold by the R. T. Vanderbilt Company of Norwalk, Conn. can be used in this invention. Thus, by way of example, one can use Darvan #1 (sodium naphthalene sulfonic acid formaldehyde), Darvan #2 (sodium salts of polymerized substituted benzoid alkyl sulfonic acids), and Darvan #6 (sodium salts of polymerized alkyl naphthalene sulfonic acid).

Some of the surfactants sold by the WestvacoPolychemicals, Charleston Heights, S.C. can be used in this invention. Thus, for example, one can use Reax 88B (sodium salt of a chemically modified low molecular weight kraft lignin polymer solubilized by 4 sulfonate groups), Reax 15B (sodium salt of sulfonated modified kraft lignin), Reax 100M (reaction product of selected modified kraft lignins with a high sulfonic acid group content), and Polyfon 0 (sugar-free, sodium-based sulfonates of Kraft lignin).

Some of the surfactants sold by the W. R. Grace & Co., Organic Chemicals Div., Lexington, Maine can be used in this invention. Thus, by way of illustration, one can use Daxad 11, 11G, 15, or 19 (sodium salts of polymerized alkyl naphthalene sulfonic acids), Daxaad 30 or 31 (sodium salt of a carboxylated polyelectrolyte), or Daxad 32 (ammonium salt of a carboxylated polyelectrolyte).

Some of the surfactants sold by the Rohm & Haas Company of Philadelphia, Pa. can be used in this invention. Thus, for example, one can use, Triton X-100 (octylphenoxy polyethoxy ethanol), Triton N-101 (nonylphenoxy polyethoxy ethanol), Tamol 731 (sodium salt of polymeric carboxylic acid), Tamol 850 (sodium salt of polymeric carboxylic acid), and Tamol SN (sodium salt of condensed naphthalene sulfonic acid).

Some of the surfactants produced by the Hamblet & Hayes Co. of Salem, Mass. can be used in this invention. Thus, e.g., one can use Tek Tan ND (condensed naptholene sulfonate).

Some of the surfactants made by the National Starch and Chemical Corp. of Bridgewater, N.J. can be used in this invention. Thus, one can use Versa TL 70 (an anionic polyelectrolyte of sodium polystyrene).

Some of the surfactants made by the Thompson-Hayward Chemical Co. of Kansas City, Kans. also can be used in this invention. Thus, for example, one can use T-DET N-100 (nonylphenol-100 mole ethylene oxide adduct), T-DET N-50 (nonylphenol-50 mole ethylene oxide adduct), T-DET N-14 (nonylphenol-14 mole ethylene oxide adduct), T-DET N-9.5 (nonylphenol-9.5 mole ethylene oxide adduct), T-DET C-40 (polyethoxylated castor oil with 40 moles of ethylene oxide), and the like.

Renex 30, a polyoxyethylene (12) tridecyl ether manufactured by the ICI Corp. of Wilmington, Del. also can be used in this invention.

Some of the Dupanol surfactants manufactured by the E. I. duPont De Nemours & Co. of Wilmington, Del. also can be used in this invention. Thus, one can use Dupanol WA and Dupanol WAQ (both sodium lauryl sulfate).

Some of the surfactants made by the Scher Chemicals, Inc. of Clifton, N.J. also can be used in this invention. Thus, one can use cocamidopropyl betaine.

One class of surfactants which can be used in this invention are the polyalkyleneoxide nonionic surfactants having a hydrophobic portion and a hydrophilic portion, wherein the hydrophilic portion comprises at least about 100 units of ethylene oxide. These surfactants are disclosed in U.S. Pat. No. 4,358,293, the disclosure of which patent is hereby incorporated by reference into this specification.

The polyalkyleneoxide nonionic surfactants suitable for use in the invention include the glycol ethers of alkylated phenols having a molecular weight of at least about 4,000 of the general formula:

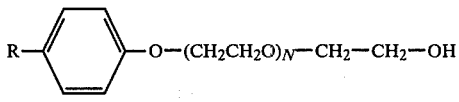

wherein R is substituted or unsubstituted alkyl of from 1 to 18 carbon atoms, preferably 9 carbon atoms; substituted or unsubstituted aryl, or an amino group, and n is an integer of at least about 100. The substituents of the alkyl and aryl radicals can include halogen, hydroxy, and the like.

Other suitable nonionic surfactants are the poly(oxyethylene)poly(oxypropylene)-poly(oxyethylene) or as otherwise described propoxylated, ethoxylated propylene glycol nonionic surfactant block polymers having a molecular weight of at least about 6,000 of the general formula:

$$HO(CH_2CH_2O)_a[CH(CH_3)CH_2O]_b(CH_2CH_2O)_cH$$

wherein a, b and c are whole integers and wherein a and c total at least about 100.

Still other polyalkyleneoxide nonionic surfactants suitable for use in the invention are the block polymers of ethylene and propylene oxide derived from nitrogen-containing compositions such as ethylene diamine and having a molecular weight of at least about 14,000 of the general formula:

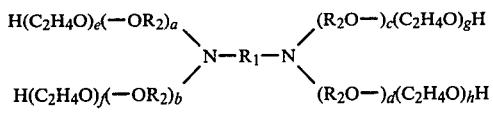

wherein $R_1$ is an alkylene radical having 2 to 5 carbon atoms preferably 2; $R_2$ is alkylene radical having 3 to 5 carbon atoms, preferably 3; a, b, c, d, e, f, g and h are whole integers; and e, f, g and h total at least about 100.

One of the preferred surfactants is

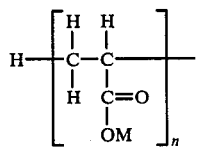

wherein M is alkali metal (and most preferably is sodium or ammonium), and n is less than 200 and, preferably, less than 100.

While, in one embodiment, the use of the sodium, potassium, or ammonium salts of condensed mononaphthalene sulfonic acid is preferred, it is to be understood that the condensed mononaphthalene sulfonic acid can be used with the addition of sodium, potassium, or ammonium alkali to form the corresponding alkali metal salt of that acid in situ.

Yet another of the surfactants which can be used in this invention is an anionic, alkylaryl sulfonate which is liquid and has an HLB number of from about 8.0 to about 15.0.

Yet another preferred surfactant is a lignin-based dispersing agent which is water soluble and which contains a sulfite lignin which ranges in molecular weight from about 1,000 to about 50,000 and whose basic lignin unit is a substituted phenylpropane. This lignin can be generated by the acid sulfite wood pulping process.

Yet another preferred surfactant is a lignin-based dispersing agent which is water-soluble and which contains an alkali lignin isolated from sulfate pulping black liquor generated in the alkaline sulfate wood pulping process.

Yet another class of preferred surfactant is a complex polymerized organic salt of sulfonic acids of the alkylaryl type such as, e.g., sodium naphthalene sulfonic acid formaldehyde, sodium salts of polymerized alkyl.

Another preferred class of surfactants is the lignosulfonates. These lignosulfonates have an equivalent weight of from about 100 to about 350, contain from about 2 to about 60 phenyl propane units (and, preferably, from about 3 to 50 phenyl propane units), and are made up of cross-linked polyaromatic chains. Some of the preferred lignosulfonates include those listed on page 293 of McCutcheon's "Emulsifiers and Detergents"), North American Edition (McCutcheon Division, MC Publishing Co., Glen Rock, N.J., 1981) and in the other portions of McCutcheon's which describes said lignosulfonates, the disclosure of which is hereby incorporated by reference into this specification. In one preferred embodiment, the lignosulfonate surfactant contains from about 0.5 to about 8.0 sulfonate groups. In this preferred embodiment, one species has 0.5 sulfonate groups, one has one sulfonate group, one has two sulfonate groups, and one has four sulfonate groups, and one has 7.5 sulfonate groups.

Applicant does not wish to be bound to any particular theory. However, he believes that a dispersing agent in a aqueous slurry system might perform at least three functions. In the first place, it is believed that a water soluble dispersing agent, which also serves as a wetting agent (such as an organic surfactant), functions to promote the wettability of the carbonaceous particles by water. As used herein, the term "wetting" indicates covering or penetrating the carbonaceous particle surface with a bound water layer. Such a wetting agent might or might not be needed, depending upon the surface chemistry of the particle, its hydrophobicity, and the associated electrochemistry of its inherent bound water layers. For example, inherent bed moisture, oxidation state of the particle, and chemical compounds already present in natural carbonaceous deposits may allow wetting of the ground material by added water.

In the second place, a dispersing agent might function to promote deflocculation of carbonaceous particles, preferably in the presence of advantageous electrolytes. As used herein, the term "deflocculating" indicates dispersion of particles, preferably of colloidal sized carbonaceous particles. Thus, e.g., a "deflocculating agent" includes a dispersing agent which promotes formation of a colloidal dispersion of colloidal sized particles in a solids-liquid slurry. It has been found that the presence of large, monovalent cations—such as $Na^+$, $Li^+$, or $K^+$-tend to promote deflocculation of colloidal sized carbonaceous particles in a solids-liquid slurry. However, higher valence cations—such as $Ca^{+2}$, $Al^{+3}$, and $Mg^{+2}$—tend to cause said particles to flocculate under certain conditions. Consequently, an organic anionic surfactant which wets the carbonaceous particles and contains a residual $Na^+$ and/or $K^+$ and an $Li^+$ can be a very effective deflocculant for the slurry.

In the third place, in some cases the dispersing agent enhances the pumpability of the system. It is believed that this effect occurs because of enhancement or inhibition of the bound, or semi-rigid, water layer because the dispersing agent provides a cation as a counterion for the bound water layer, thereby affecting the yield pseudoplastic index (slope of a plot of log viscosity versus log shear rate) of the mass. Preferably, the cation provided by the dispersing agent is $NH_4^+$, $Na^+$ and/or $K^+$. Consequently, it is preferred to incorporate an advantageous electrolyte, such as an ammonium or alkali metal base, into an aqueous slurry to increase deflocculation of the slurry.

It is preferred that the dispersing agent(s) used in the system provide one or more ions to the system. As used in this specification, the term "ion" includes an electrically charged atom, an electrically charged radical, or an electrically charged molecule.

In one preferred embodiment, the dispersing agent(s) used in the system provides one or more counterions which are of opposite charge to that of the surface of the carbonaceous particles. The charge on the surface of the carbonaceous particles in water is generally negative, and thus it is preferred that said counterions have a positive charge. The most preferred positively charged ions are the sodium and potassium cations and the ammonium radical.

In one embodiment it is preferred that the dispersing agent(s) used in the system be a polyelectrolyte which, preferably, is organic. As used in this specification, the term "polyelectrolyte" indicates a polymer which can be changed into a molecule with a number of electrical charges along its length. It is preferred that the polyelectrolyte have at least one site on each recurring structural unit which, when the polyelectrolyte is in aqueous solution, provides electrical charge; and it is more preferred that the polyelectrolyte have at least two such sites per recurring structural unit. In a preferred embodiment, said sites comprise ionizable groups selected from the group consisting of ionizable carboxylate, sulfonate, sulfate, and phosphate groups. Suitable polyelectrolytes include, e.g., the alkali metal and ammonium salts of polycarboxylic acids such as, for instance, polyacrylic acid; the sodium salt of condensed naphthalene sulfonic acid; polyacrylamide; and the like.

In one preferred embodiment, the slurry system contains from about 0.05 to about 4.0 weight percent by weight of dry solids in the slurry, of an electrolyte which, preferably, is inorganic. As used in this specification, the term "electrolyte" refers to a substance that dissociates into two or more ions to some extent in water or other polar solvent. This substance can be, e.g., an acid, base or salt.

In a more preferred embodiment, the slurry system is comprised of from about 0.05 to about 2.0 weight percent of an inorganic electrolyte. In the most preferred embodiment, said system is comprised of from about 0.1 to about 0.8 weight percent of said electrolyte. In the most preferred embodiment, the system contains from about 0.1 to about 0.5 percent of inorganic electrolyte.

Any of the inorganic electrolytes known to those skilled in the art can be used in the coal-water system Thus, by way of illustration and not limitation, one can use the ammonia or alkali metal salt of hexametaphosphates, pyrophosphates, sulfates, carbonates, hydroxides, and halides. Alkaline earth metal hydroxides can be used. Other inorganic electrolytes known to those skilled in the art also can be used.

In one preferred embodiment, the inorganic electrolyte is of the formula $$M_aZ_b$$

wherein M is an alkali metal selected from the group consisting of lithium, sodium, potassium, rubidium, cesium, and francium; b is the valence of metal M; a is the valence of anion Z; and Z is an anion selected from the group consisting of hexametaphosphate, pyrophosphate, silicate, sulfate, carbonate, hydroxide, and halide anions. It is preferred that Z be selected from the group consisting of carbonate, hydroxide, and silicate anions. The most preferred electrolytes are selected from the group consisting of potassium carbonate, sodium hydroxide, and $Na_2SiO_3\ 9H_2O$.

It is preferred that the slurry system contain both said dispersing agent(s) and said inorganic electrolyte(s) and that from about 0.05 to about 10.0 parts (by weight) of the inorganic electrolyte are present for each part (by weight) of the dispersing agent(s) in the system.

It is preferred that the total concentration of both the dispersing agent(s) and/or the inorganic electrolyte be from 0.05 to 4.0 weight percent.

In one preferred embodiment, the grinding mixture is comprised of dispersing agent(s) and inorganic electrolyte agent(s) which, when dissolved in water provide electrically charged ions to the mixture. The amount of electrically charged ions preferably present in the mixture ranges from about 0.01 to about 2.5 weight percent, based upon weight of dry carbonaceous materials and most preferably is from about 0.05 to about 2.0 weight percent. Said concentration of electrically charged ions can be calculated by first calculating the weights of the ions in each of the dispersing agent(s) and the electrolyte agent(s), adding said weight(s), and then dividing the total ion weight by the weight of the dry coal.

By way of illustration, in one embodiment 0.75 grams of sodium hydroxide and 0.75 grams of sodium decyl benzene sulfonate were added to a mixture comprised of 100 grams of dry coal. The weight of the sodium ion provided by the caustic was equal to $22/40\times0.75$ grams; and it equals 0.4125 grams. The weight of the sodium ion provided by the sodium decyl benzene sulfonate was equal to $22/294\times0.75$ grams; and it equals 0.0561 grams. The total weight of the sodium ion provided by both the caustic electrolyte and the sulfonate dispersing agent was 0.4686 grams. Thus, the slurry contained 0.468 weight percent of sodium ion.

In one preferred embodiment, the grinding mixture used in the process of this invention is dilatant. A discussion of dilatant materials appears at page 5–38 of Perry and Chilton's "*Chemical Engineers' Handbook*", Fifth Edition (McGraw-Hill Book Company, New York, 1973), the disclosure of which is hereby incorporated into this specification by reference. In general, as is known to those skilled in the art, dilatant materials exhibit rheological behavior opposite to that of pseudoplastics; their apparent viscosity increases with increasing shear rate.

Some examples of dilatant materials are starch or mica suspensions in water, quicksand, and beach sand. Extensive discussions of dilatant suspensions, together with a listing of dilatant systems, are given by Bauer and Collins ("Thixotropy and Dilatancy" in Eirich, "Rheology", Vol. 4, Academic, New York, 1967); Green and Griskey, (Trans. Soc. Rheology 12(1), 13–25, 27–37, 1968); and Griskey and Green (Am. Inst. Chem. Engrs. J., 17, 725–728, 1971). The disclosure of said Bauer et al., Green at al., and Griskey et al. references are hereby incorporated by reference into this specification.

It is preferred that the pH of the grinding mixture used in the process of this invention be from about 5 to about 12 and, preferably, from about 7 to about 11. The pH of the grinding mixture can be adjusted by means well known to those in the art such as, e.g., by adding alkali metal hydroxide (such as sodium hydroxide and/or potassium hydroxide) to the grinding mixture until its pH is within the target range.

The grinding mixture of this invention can be produced by means well known to those skilled in the art.

One such means will be described below, it being understood that other comparable means also can be used.

In one process, the grinding mixture of this invention is prepared by a process comprising the steps of (1) preparing a slurry without fines which slurry contains from about 40 to about 60 weight percent of solid carbonaceous material; (2) grinding said slurry to a fine grind until the median particle size of the carbonaceous particles in the slurry is from about 0.5 to about 40 microns; (3) crushing dry coal until at least 98 weight percent of its particles are smaller than 50 mesh (300 microns), provided that the median particle size of the crushed coal exceeds about 40 microns; and (4) blending the ground slurry and the crushed coal in specified proportions, together with dispersant.

In the first step of this process, a carbonaceous slurry comprised of from about 40 to about 70 volume percent of carbonaceous solid material and from about 60 to about 30 volume percent of carrier liquid is prepared; it is preferred that the slurry contain from about 35 to about 65 volume percent of carbonaceous solid material and from about 65 to about 35 volume percent of carrier liquid.

In the second step of this process, the slurry from step one of the process is fine ground in a fine grinder until the median particle size of its particles of solid carbonaceous material is from about 0.5 to about 40 microns and, preferably, from about 1 to about 30 microns. It is most preferred to fine grind the slurry until the median particle size of its particles of solid carbonaceous material is from about 2 to about 20 microns. The slurry can be fine ground by means well known to those skilled in the art. Thus, by way of example, the slurry can be fine ground in a stirred ball mill, a colloid mill, a vibratory mill, etc.

In the third step of this process, dry carbonaceous material is separately ground until its median particle size exceeds about 40 microns and about 98 percent of its particles are smaller than $\frac{3}{8}$ inch. One may start with any size dry coal in this step and grind it.

In the fourth step of this process, the fine and coarse carbonaceous fractions are mixed until a grinding mixture with the desired composition is obtained.

The grinding step of the process of this invention.

As indicated above, in the process of this invention the aforementioned grinding mixture is provided by mixing solid carbonaceous material, carrier liquid, and dispersing agent. Thereafter, the grinding mixture is wet ground until a slurry with specified properties is produced. Thus, in general, the grinding is continued to produce a stable, solids-liquid slurry comprising a consist of finely-divided particles of solid carbonaceous material dispersed in said liquid, wherein:

(a) said slurry is comprised of at least about 60 volume precent of said solid carbonaceous material (dry basis), less than about 40 volume percent of said liquid, and from about 0.01 to about 4.0 weight percent (based on weight of dry solid carbonaceous material) of dispersing agent;

(b) said slurry has a yield stress of from about 3 to about 18 Pascals and a Brookfield viscosity at a solids content of 70 volume percent, ambient temperature, ambient pressure, and a shear rate of 100 revolutions per minute of less than 5,000 centipoise;

(c) said consist has a specific surface area of from about 0.8 to about 4.0 square meters per cubic centimeter and an interstitial porosity of less than 20 volume percent;

(d) from about 5 to about 70 volume percent of said particles of solid carbonaceous material are of colloidal size, being smaller than about 3 microns;

(e) said consist of finely-divided particles of solid carbonaceous material has a particle size distribution substantially in accordance with the following formula:

$$\frac{CPFT}{100} = \sum_{j=1}^{k} \left[ X_j \left( \frac{D^{Nj} - D_{sj}^{Nj}}{D_{Lj}^{Nj} - D_{sj}^{Nj}} \right) \right]$$

where $\sum_{j=1}^{k} X_j = 1.0$ and where if $D < D_{sj}$ $\left( \frac{D^{Nj} - D_{sj}^{Nj}}{D_{Lj}^{Nj} - D_{sj}^{Nj}} \right) = 0.0$ and where if $D > D_{Lj}$ $\left( \frac{D^{Nj} - D_{sj}^{Nj}}{D_{Lj}^{Nj} - D_{sj}^{Nj}} \right) = 1.0$ wherein:

1. CPFT is the cumulative percent of said solid carbonaceous material finer than a certain specified particle size D, in volume percent;
2. k is the number of component distributions in the consist and is at least 1;
3. $X_j$ is the fractional amount of the component j in the consist, is less than or equal to 1.0, and the sum of all of the $X_j$'s in the consist is 1.0;
4. n is the distribution modulus of fraction j and is greater than about 0.001;
5. D is the diameter of any particle in the consist and ranges from about 0.05 to about 1180 microns;
6. $D_s$ is the diameter of the particle in fraction j, measured at 1% CPFT on a plot of CPFT versus size D, is less than $D_L$, and is greater than 0.05 microns;
7. $D_L$ is the diameter of the size modulus in fraction j, measured by sieve size or its equivalent, and is from about 10 to about 1180 microns; and
8. no more than about 0.05 volume percent of the particles in the slurry consist have a diameter less than about 0.05 microns;

(f) the net zeta potential of said colloidal size particles of solid carbonaceous material is from about 15 to about 85 millivolts; and (g) the concentration of solid carbonaceous material in said slurry, the interstitial porosity of said consist, the specific surface area of said consist, and the zeta potential of said colloidal size particles of solid carbonaceous material are interrelated in accordance with the following formula:

$$V_s + P_s + SA + 240/ZP = H$$

wherein:

1. $V_s$ is the percent, by volume, of solid carbonaceous material in said slurry;
2. P is the porosity of said consist in the slurry, in percent;

3. S.A. is the specific surface area of said consist in said slurry, in square meters per cubic centimeter;
4. Z.P. is the net zeta potential of said colloidal size particles of carbonaceous material in said consist, in millivolts, and
5. H is from about 75 to about 98.

The slurry produced by the grinding process of this invention has a yield stress of from about 3 to about 18 Pascals. It is preferred that the yield stress be from about 5 to about 15 Pascals, and it is more preferred that the yield stress be from about 7 to about 12 Pascals. As is known to those skilled in the art, the yield stress is the stress which must be exceeded before flow starts. A shear stress versus shear rate diagram for a yield pseudoplastic or a Bingham plastic fluid usually shows a non-linear hump in the rheogram at the onset of flow; extrapolating the relatively linear portion of the curve back to the intercept of the shear stress axis gives the yield stress. See, for example, W. L. Wilkinson's "Non-Newtonian Fluids, Fluid Mechanics, Mixing and Heat Transfer" (Pergamon Press, New York 1960), pages 1–9, the disclosure of which is hereby incorporated herein by reference. Also see Richard W. Hanks, et al's "Slurry Pipeline Hydraulics and Design" (Pipeline Systems Incorporated, Orinda, Calif., 1980), pages II-1 to II-10, the disclosure of which is also hereby incorporated herein by reference.

The Brookfield viscosity of the slurry produced by the process of this invention is less than about 5,000 centipoise. The Brookfield viscosity is tested after the solids concentration of the slurry is adjusted to a solids content of 70 volume percent (the slurry is either diluted or concentrated until it has this concentration of solids) at ambient temperature, ambient pressure, and a shear rate of 100 revolutions per minute. It is preferred that the viscosity of the slurry be less than 4,000 centipoise. It is more preferred that the viscosity of the slurry be less than 3,000 centipoise. In an even more preferred embodiment, the viscosity of the slurry is less than 2,000 centipoise. In the most preferred embodiment, the viscosity of the slurry is less than 1,000 centipoise.

The term "Brookfield viscosity", as used in this specification, describes viscosity as measured by conventional techniques by means of a Brookfield Synchro-Lectric Viscosimeter (manufactured by the Brookfield Engineering Laboratories, Stoughton, Mass., U.S.A.).

The solids-liquid slurry produced by the process of this invention contains a consist of finely-divided particles of solid carbonaceous material dispersed in said liquid. Said consist has a specific surface area of from about 0.8 to about 4.0 square meters per cubic centimeter. It is preferred that said specific surface area be from about 0.8 to about 3.0 $m^2$/c.c. It is more preferred that the specific surface area be from about 0.8 to about 2.4 $m^2$/cc. In an even more preferred embodiment, the specific surface area is from about 0.8 to about 2.0 $m^2$/cc.

As used in this specification, the term "specific surface area" refers to the summation of the surface area of equivalent spheres in the particle size distribution as measured by sieve analysis and sedimentation techniques; the particle size distribution of the consist in the slurry is first determined, it is assumed that all particles in the consist are spherical, and then one calculates the surface area based on this assumption. As used herein, the term "consist" refers to the particle size distribution of the solid phase of the solids-liquid slurry.

For any given consist, one can determine the particle size distribution by means well known to those skilled in the art. For measuring particle sizes and for determining particle size distributions of pulverized and fine grind carbonaceous particles used for preparing a carbonaceous slurry, the following two means of measuring particle sizes can be used and are preferred:

1. U.S. Series sieves Nos. 16, 20, 30, 40, 50, 70, 100, 140, 200, 270, are used to determine weights of carbonaceous particles passing through each sieve in the range of about (−) 1180 μm to (−) 52 μm. The cumulative volume percents of particles, dry basis, finer than (CPFT) a particular stated sieve size in microns is charted against the sizes in microns on a log-log chart, referred to herein as a "CPFT chart", to indicate the nature of the particle size distribution of 16 mesh×270 mesh particles.
2. A Sedigraph 5500L (made by Micromeritics, Co., Norcross, Ga., U.S.) is used to measure particle sizes and numbers of particles in the carbonaceous material and in the slurry in the range of (−) 75 μm to about 0.2 mm. The Sedigraph 5500L uses photoextinction of settling particles dispersed in water according to Stoke's law as a means for making the above determinations. Other instruments, such as a Coulter Counter or combinations of the Leeds & Northrup Microtrac Particle Analyzers can also be used for similar accuracy. The results can be plotted on a CPFT chart. Although these data do not necessarily extend to the size axis at 1% CPFT, the "$D_s$ at 1%" can be determined by extrapolating the CPFT chart line to this axis and reading the intercept. This number, although not the true $D_s$, can be effectively used in a computer algorithm to determine % porosity and specific surface area.

In addition to the above methods, particle size measurements can be estimated from methylene blue index measurements to obtain an approximate determination of the wgt. % of colloidal particles of size below 1 mm. Such a procedure is described in A.S.T.M. Standard C837-76. This index can be compared with the surface area calculated by the CPFT algorithm.

Once the particle size distribution of the consist is determined, it is assumed that each particle in the consist is spherical with a surface area of $\pi D^2$; the diameter D of the particles in each class of particles in the consist is known; and the surface area of the particles in each class is calculated and summed.

The consist in the slurry produced by the process of this invention has an interstitial porosity of less than about 20 volume percent. It is preferred that said interstitial porosity be less than about 15 volume percent, and it is more preferred that said interstitial porosity be less than about 10 percent. The interstitial porosity is a function of the volume of the interstices between the particles in the slurry consist. For any given space full of particles, the interstitial porosity is equal to the "minimum theoretical porosity" in accordance with the equation presented below.

$$\text{Minimum Theoretical Porosity} = 40\% \ (1 - [1/VA])$$

where VA is as defined by the following modified WestmanHugill algorithm:

$$VA_1 = A_1X_1$$
$$VA_2 = X_1 + A_2X_2$$
$$VA_3 = X_1 + X_2 + A_3X_3$$

$$\vdots$$

$$VA_i = \sum_{j=1}^{i-1} X_j + A_iX_i$$

$$\vdots$$

$$VA_n = \sum_{j=1}^{n-1} X_j + A_nX_n$$

wherein:

$A_i$=Apparent volume of a monodispersion of the $i^{th}$ size particle, $X_i$=Mass fraction of the $i^{th}$ size particles, $VA_i$=Apparent volume calculated with reference to the $i^{th}$ size particles, n=Number of particle sizes, and VA=Maximum value of $VA_i$=Apparent volume of the mixture of n particle sizes.

To determine the interstitial porosity of any consist, the particle size distribution of said consist can be determined by the method described above with reference to the measurement of the specific surface area. Thereafter, it is assumed that each particle in the consist is spherical, the volume of the particles is calculated in accordance with this assumption, and the interstitial porosity of the consist is then calculated in accordance with the above formula. It is noted that this calculated porosity is less than the true porosity of a consist as measured, for example, by liquid loss-due to the non-spherical morphology (shape) of the particles, and by invocation of $D_s$ at 1%.

The slurry produced by the process of this invention contains a consist which is comprised of at least about 5 weight percent of colloidal particles, and, preferably, from about 5 to about 70 weight percent of colloidal particles. As used herein, the term "colloidal" refers to a substance of which at least one component is subdivided physically in such a way that one or more of its dimensions lies in the range of 100 angstroms and 3 microns. As is known, these are not fixed limits and, occasionally, systems containing larger particles are classified as colloids. See *Encyclopedia Of Chemistry,* 2d Edition, Clark et al (Reinhold, 1966), page 203, the disclosure of which is hereby incorporated herein by reference.

It is preferred that, in the carbonaceous consist used in the slurry of this invention, at least 5 weight percent of the carbonaceous particles are smaller than about 3.0 microns. It is preferred that from about 5 to about 70 weight percent of the carbonaceous particles in said consist be smaller than 3.0 microns. In one preferred embodiment, from about 5 to about 30 weight percent of the carbonaceous particles in said consist are smaller than 3.0 microns. In another preferred embodiment, from about 7 to about 20 weight percent of the particles in said consist are smaller than 3.0 microns.

The slurry produced by the process of this invention comprises a compact of finely-divided cabonaceous particles dispersed in fluid such as, e.g., finely-divided coal particles dispersed in water. The term compact, as used in this specification, refers to a mass of finely-divided particles which are closely packed in accordance with this invention.

The particles in the compact of said slurry have a specified particle size distribution which is substantially in accordance with the aforementioned CPFT formula, wherein CPFT is the cumulative percent of the carbonaceous solid finer than a certain specified particle size D, in volume percent; k is the number of component distributions in the consist, is at least 1, and preferably is from about 1 to about 30, and most preferably is 1; $X_j$ is the fractional amount of the component j in the consist, is less than or equal to 1.0, and the sum of all $X_j$'s in the consist is 1.0; n is the distribution modulus (or slope) of fraction j, is greater than about 0.001, preferably is from about 0.001 to about 10.0 and more preferably from 0.01 to about 1.0, and most preferably is from about 0.01 to about 0.5; D is the diameter of any particle in the consist and ranges from about 0.05 to about 1180 microns; $D_s$ is the diameter of the smallest particle in fraction j (as measured by extrapolating the CPFT chart line, if necessary, to one percent CPFT using data from sieve analyses plus the Micromeritics Sedigraph 5500L) and is generally greater than 0.05 microns but is less than $D_L$, and no more than about 0.05 volume percent of the particles in the slurry consist have a size less than 0.05 microns; $D_L$ represents the diameter of the largest particle in fraction j (sieve size or its equivalent), it ranges from about 10 to about 1180 microns, preferably is from about 30 to about 420 microns, and most preferably is from about 100 to about 300 microns; $D_L$ is the theoretical size modulus of the particle size distribution; when CPFT is plotted against size, the $D_L$ value is indicated as the intercept on the upper X axis of the CPFT/D plot. However, as is known to those skilled in the art, because of aberrations in grinding the coarse end of a particle size distribution, the actual top particle size is always larger than the $D_L$ obtained by, e.g., the particle size equation described in this case; thus, e.g., a $D_L$ size modulus of 250 microns will usually produce a particle distribution with at least about 98 percent of the particles smaller than 300 microns. Consequently, slurry of this invention has a compact with a particle size distribution which is substantially in accordance with the CPFT equation; minor deviations caused by the actual top size being greater than the $D_L$ are within the scope and spirit of this invention.

When k is 1, the aforementioned equation simplifies to:

$$\frac{CPFT}{100} = \frac{D^n - D_s^n}{D_L^n - D_s^n}$$

when k is 2, the equation becomes:

$$\frac{CPFT}{100} = \underbrace{X_1\left(\frac{D^{N1} - D_{s1}^{N1}}{D_{L1}^{N1} - D_{s1}^{N1}}\right)}_{\text{I}} + \underbrace{X_2\left(\frac{D^{NL} - D_{s2}^{N2}}{D_{L2}^{N2} - D_{s2}^{N2}}\right)}_{\text{II}}$$

wherein: $X_1+X_2=1.0$ (i.e., the sum of the fractional parts is equal to the whole); when D is less than or equal to $D_{s1}$, the first term in the parentheses (term I) is equal to 0.0; when D is greater than or equal to $D_{L1}$, the first term in the parentheses (term I) is equal to 1.0; when D is less than $D_{S2}$, the second term in the parentheses (term II) is equal to 0.0; when D is greater than $D_{L2}$, the second term in the parentheses (term II) is equal to 1.0.

The reason for the aforementioned constraints of the terms in parentheses I and II is that each of these terms refers to the equation of one of the two components.

In order to sum the fractional parts of the two component distributions, the above considerations must be included since particles of a certain size may be represented between the effective $D_S$ and $D_L$ of the total distribution but not between the $D_S$ or $D_L$ of one of the component distributions. Thus, the values in parentheses I and II are subject to the limitations that, when D is less than or equal to $D_S$, the value for the term is 0.0 and when D is greater than $D_{Lj}$, the value of the term is 1.0.

The equation given above for when k is 2 is simply the sum of two components where the fraction of component $j_1$ is $X_1$ and the fraction of component $j_2$ is $X_2$. Since, in this case, $X_1$ and $X_2$ make up the whole distribution, their sum must equal 1.0.

In accordance with the above reasoning, when k=3, the equation becomes:

$$\frac{CPFT}{100} = X_1\left(\frac{D^{N1} - D_{s1}^{N1}}{D_{L1}^{N1} - D_{s1}^{N1}}\right) + X_2\left(\frac{D^{N2} - D_{s2}^{N2}}{D_{L2}^{N2} - D_{s2}^{N2}}\right) + X_3\left(\frac{D^{N3} - D_{s3}^{N3}}{D_{L3}^{N3} - D_{s3}^{N3}}\right)$$

When K=4, there is a fourth term in the equation equal to $$X_4\left(\frac{D^{N4} - D_{s4}^{N4}}{D_{L4}^{N4} - D_{s4}^{N4}}\right)$$

In the slurry produced by the process of this invention, it is preferred that no more than 0.5 weight percent of the solid carbonaceous particles in the slurry have a particle size less than 0.05 microns. It is preferred that at least 85 weight percent of the carbonaceous particles in the slurry have a particle size less than 300 microns. It is more preferred that at least 90 weight percent of the carbonaceous particles in the slurry have a particle size less than 300 microns. In the most preferred embodiment, at least 95 weight percent of the carbonaceous particles in the slurry have a particle size less than 300 microns.

In a preferred embodiment, the fluid is water and the colloidal sized carbonaceous particles in the slurry have a net zeta potential of from about 15 to about 85 millivolts. The following discussion of zeta potential will refer to a coal-water slurry, it being understood that the discussion is equally applicable to, e.g., coke-water slurries, graphite-water slurries, etc.

It is preferred that the colloidal sized particles of coal in the coal-water slurry have a net zeta potential of from about 15 to about 85 millivolts. As used herein, the term "zeta potential" refers to the net potential, be it positive or negative in charge; thus, a zeta potential of from about 15.4 to 70.2 millivolts includes zeta potentials of from about −15.4 to about −70.2 millivolts as well as zeta potentials of from about +15.4 to about +70.2 millivolts. In a more preferred embodiment, said zeta potential is from about 30 to 70 millivolts.

As used in this specification, the term "zeta potential" has the meaning given it in the field of colloid chemistry. Concise discussions and descriptions of the zeta potential and methods for its measurement are found in many sources including, T. M. Riddick, U.S. Pat. No. 3,454,487, issued July, 1969; Douglas et al., U.S. Pat. No. 3,976,582 issued Aug. 24, 1976; *Encyclopedia of Chemistry,* 2nd edition, Clark et al., Reinhold Publ. Corp. 1966, pages 263–265; *Chemical and Process Technology Encyclopedia, D. M. Considine, editor-in-chief, McGraw-Hill Book Company, N.Y., pages* 308–309; *Chemical Technology: An Encyclopedic Treatment,* supra, Vol. VII, pages 27–32; Kirk-Othmer, *Encyclopedia of Chemical Technology,* 2nd Edition, Vol. 22, pages 90–97; and T. M. Riddick, *Control of Colloid Stability Through Zeta Potential,* Zeta-Meter, Inc. New York City. The disclosures of the aforementioned documents are hereby incorporated into this specification by reference.

"Zeta potential" may be measured by conventional techniques and apparatus of electroosmosis such as those described, e.g., in Potter, "Electro Chemistry"; Cleaver Hume Press, Ltd.; London (1961). Zeta potential can also be determined by measuring electrophoretic mobility (EPM) in any of several commercial apparatuses. In the present invention, a Pen Kem System 3000 (made by Pen Kem Co. Inc. of Bedford Hills, N.Y.) was used for determining zeta potential in the examples herein. This instrument is capable of automatically taking samples of coal particles and producing an EPM distribution by Fast Fourier Transform Analysis from which the average zeta potential can be calculated in millivolts.

The zeta potential is measured using very dilute samples of the <10 μm sized coal particles in the coal compact of the coal-water slurry.

It is preferred that the zeta potential of the colloidal sized coal particles in the coal consist of the slurry of this invention be negative in charge and be from about −15.4 to about −70.2 millivolts. It is more preferred that said zeta potential be from about −30 to about −70 millivolts.

In one embodiment, it is preferred that the zeta potential of said colloidally sized coal particles be "near maximum". "Near maximum zeta potential", as used in this specification, means a value of zeta potential, measured at constant electrical conductivity, below the maximum zeta potential as defined and discussed in the references cited in the portion of this specification wherein the term "zeta potential" is defined. It is sometimes necessary to normalize the zeta potential values with respect to the electrical conductivity of the carrier fluid because zeta potential is limited by the electrical conductivity of the carrier fluid. The near maximum zeta potential should be of a millivoltage sufficient to provide the coal particles with a repulsive charge great enough to disperse the coal particles in the coal-water slurry. In this embodiment, it is preferred that the zeta potential on the colloidal coal particles be from about 20 to about 95 percent of the maximum zeta potential. It is more preferred that the zeta potential on the colloidal coal particles be from about 40 to about 80 percent of the maximum zeta potential for this embodiment.

The maximum zeta potential may be determined by measuring the Brookfield viscosity of the slurry at different zeta potentials. For a given system, maximum zeta potential has been reached when further increases in the surfactant concentraton in the slurry do not further decrease the Brookfield viscosity of the system at 100 rpm.

One preferred means for measuring the zeta potential is to grind a sample of coal in either a laboratory size porcelain ball mill with porcelain balls in distilled water at 30 weight percent solids for approximately 24 hours or in a steel ball mill with steel balls at 30 weight percent solids for 16 hours or until all of the particles in the coal are less than 10 microns in size. Small samples of this larger sample can then be prepared in a known way by placing them in a vessel equipped with a stirrer with a sample of water to be used as a carrier in the coal-water slurry. Various acidic and basic salts are then added in incremental amounts to vary the pH, and various concentrations of various candidate dispersing agent organic surfactants likewise are added in incremental amounts (e.g., grams per gram coal, both dry basis), alone or in combinations of two or more. These samples are then evaluated in any electrophoretic mobility, electroosmosis, or streaming potential apparatus to determine electrical data, from which the zeta potential is calculated in a known way. Plots of zeta potential, pH, and specific conductance vs concentration may then be made to indicate candidate surfactants, or combinations thereof to be used to produce the optimum dispersion of coal particles in the carrier water below the amount at which dilatency may be reached.

Illustration of the grinding process

Several typical means of practicing the process of applicant's invention are illustrated in FIG. 2. In a wet grinding method, carbonaceous material is charged to crusher 10 and crusher 12. In one embodiment, it is preferred that one carbonaceous material be charged to crusher 10 and another carbonaceous material be charged to crusher 12. In another preferred embodiment, different types of the same carbonaceous material are charged to crushers 10 and 12. In this latter embodiment, the carbonaceous material charged to crushers 10 and 12 can be, e.g., coal, a coal fraction which contains less than about 30 weight percent of volatilizable hydrocarbons (such as, e.g., anthracite or low volatile bituminous coal) can be charged to crusher 10, and a coal fraction which contains more than about 35 weight percent of volatilizable hydrocarbons (such as, e.g., lignite or high volatile bituminous coal) can be charged to crusher 12.

Any of the crushers known to those skilled in the art to be useful for crushing carbonaceous material can be used as crusher 10 and/or crusher 12. The same crusher can be used for crushers 10 or 12, or different crushers can be used. Thus, by way of illustration and not limitation, one can use, e.g., a rod mill, a gyratory crusher, a roll crusher, a jaw crusher, a cage mill, and the like. Generally, the carbonaceous material is crushed to a size of about $\frac{1}{4}'' \times 0$, although coarser and finer fractions can be used.

The crushed material from crusher 10 is fed through line 14. The crushed material from crusher 12 is fed through line 16. Part or all of the crushed material from crusher 10 can be mixed with part or all of the crushed material from crusher 10 by passing the crushed material in line 14 and/or the crushed material in line 16 through transfer line 18. Alternatively, transfer line 18 can be closed, the crushed material from crusher 10 can be fed directly to mill 26, and the crushed material from crusher 12 can be fed directly to dry grinder 24.

The crushed material from either crusher 10 or 12 can be sampled and measured for pH in the ph meter 13, which will be discussed later, thus establishing a baseline for the entire control circuit discussed later.

The crushed material from crusher 10 can be fed through line 14 to mill 26. Mill 26 can either be a tumbling mill (such as a ball mill, pebble mill, rod mill, tube mill, or compartment mill), or a non-rotary ball or bead mill, such as stirred mills (including the Swecon dispersion mill, the Attritor, the Bureau of Mines mill described in U.S. Pat. No. 3,075,710), vibratory mills such as the Vibro-Energy mill, the Podmore-Boulton mill, the Vibratom, and the like. In general, the various processes and apparatuses which can be used to mill the crushed material are well known to those skilled in the art and are described in e.g., Perry and Chilton's *Chemical Engineer's Handbook,* Fifth Edition (McGraw Hill, New York, 1973) at pages 8-16 to 8-44 (crushing and grinding equipment), the disclosure of which is hereby incorporated by reference into this specification.

In one preferred embodiment, mill 26 is a ball mill which, preferably, is run at a reduced speed. In this embodiment, the mixture is ground at said high solids content of from about 60 to about 82 volume percent of carbonaceous material and at a ball mill speed of from about 50 to about 70 percent of the ball mill critical speed. Thus, for example, the grinding mixture of this invention can be ground in a ball mill at a speed of from about 50 to about 70 percent of the ball mill critical speed. The critical speed of the ball mill is the theoretical speed at which the centrifugal force on a ball in contact with the mill shell at the height of its path equals the force on it due to gravity, and it is defined by the equation $$N_c = 76.6/D$$

wherein $N_c$ is the critical speed (in rpm), and D is the diameter of the mill (feet) for a ball diameter that is small with respect to the mill diameter. It is preferred to run ball mill 26 at less than about 60 percent of its critical speed and, more preferably, at less than about 55 percent of its critical speed. The use of reduced critical speed grinding produces a slurry with improved viscosity and stability properties.

In general, mill 26 will have sufficient carbonaceous material and liquid fed to it so that it will contain from about 60 to about 82 volume percent of carbonaceous material. Crushed material is fed to mill 26 through line 14. Alternatively or additionally, milled carbonaceous material (which might or might not contain carrier liquid, such as water) from mill 26 can be recycled through line 40 back into mill 26; this recycled milled carbonaceous material can be either fine milled material which passes through a sieve bend 38 and/or coarser milled material which does not pass through sieve bend 38. Alternatively or additionally, milled carbonaceous material from mill 46 (which preferably contains carrier liquid) can be recycled into mill 26 through lines 48, 58, and 60, or into mill 46 through line 61. Alternatively or additionally, carbonaceous material (which preferably contains carrier liquid) which has been mixed in high shear mixer 64 can be recycled back into mill 26 through lines 66 and 60, or into mill 46 through lines 61.

Carrier liquid is fed to mill 26 through line 20. A sufficient amount of said carrier liquid is fed into the mill 26 so that, in combination with all of the other feeds to mill 26, a solid-liquid mixture which contains from about 60 to about 82 volume percent of carbonaceous material is produced.

The mill 26 will have sufficient solids and liquid fed to it so that it will contain from about 60 to about 82 volume percent of solid carbonaceous material. Generally, one should charge from about 0 to about 10 volume percent more solid carbonaceous material to mill 26 than he desires in the final slurry product, subject to the qualification that in no event should more than 82 volume percent of such material be charged to the mill.

Dispersing agent can be added to mill 26 through line 22. For a given material, dispersant, and solids content, a given amount of dispersant will optimize zeta potential; and this amount can be determined in accordance with the screening tests described in this specification. In general, a sufficient amount of dispersant is added through line 22 and/or line 62 and/or line 88 so that the slurry in mill 26 contains from about 0.01 to about 4.0 weight percent of one or more dispersing agents, based on weight of dry carbonaceous material.

A portion of the milled slurry from mill 26 is passed via line 28 through viscometer 30, density meter 32, ph meter 33, and line 27 back to line 28; a portion of the slurry passed to density meter 32 is also passed to particle size distribution analyzer 34. The function of viscometer 30, density meter 32, ph meter 33, and particle size distribution analyzer 34 is to continually monitor the quality of the slurry being produced in mill 26 so that, if necessary, the process can be adjusted by adjusting the feeds of solids and/or solids-fluid slurry and/or liquid and/or dispersant and/or ground carbonaceous material and/or solid-liquid slurry to the mill.

Any of the viscometers known to those skilled in carbonaceous material and/or solid-liquid slurry to the mill. the art can be used as viscometer 30. Thus, by way of illustration, one can use a Nametre Viscometer. The viscometer 30 indicates the viscosity of the ground slurry. If the viscosity of the ground slurry is higher than desired, then either mill 26 is not grinding the coal to produce a sufficiently high surface area and low porosity, and/or the amount or type of dispersing agent used is insufficient to produce a sufficiently high zeta potential on the colloidal carbonaceous particles; and the underflow slurry should be subjected to further tests (in density meter 32, ph meter 33, particle size distribution analyzer 34).

Any of the density meters known to those skilled in the art can be used as density meter 32. Density meter 32 indicates the density of the slurry, which directly varies with its solids content. If the density of the slurry is lower or higher than desired, then it is possible that the particle size distribution of the carbonaceous compact in the underflow slurry is lower or higher than desired. In this case, the slurry should be subjected to further tests in particle size analyzer 34 to determine what the particle size distribution of the underflow slurry is and its attendant surface area and porosity are.

Any ph meters known to those skilled in the art, such as, e.g., Leeds & Northrup in-line ph meter, can be used as ph meter 33. The ph meter measures the hydrogen ion concentration of the slurry, which can vary with water quality, the oxidation state of the carbonaceous or pyrite surfaces, soluble ingredients within the carbonaceous material, or errors in dispersant additions.

Particle size distribution analyzer 34 analyzes the particle size distribution of the compact of the underflow slurry. Any of the particle size distribution analyzers known to those skilled in the art, such as, e.g., Micromeritics Sedigraph 5500L, Coulter Counter, Leeds and Northrup Microtrac Particle Analyzers, can be used as analyzer 34. From the data generated by analyzer 34, the specific surface area and the porosity of the compact of underflow slurry can be determined.

Ground slurry from mill 26 is passed through line 28 to sieve bend 38. Sieve bend 38 may be 40 mesh sieve which, preferably, allows underflow slurry of sufficient fineness (such as, e.g., less than 420 microns) through to line 29 into mill 46 where it is subjected to further grinding; alternatively, all or part of this fine ground slurry can be recycled into mill 26 via line 40. Overflow particles which are greater than 420 microns are recycled via line 40 back into mill 26, where they are subjected to further grinding.

The ground slurry from mill 26 which passes through sieve bend 38 can be passed through line 29 to mill 46. Mill 46 can be a rod mill, a ball mill, or a stirred ball mill; it preferably is a ball mill. It is preferred that the slurry be passed to mill 46 until at least about 95 volume percent of the particles in the slurry have particles less than about 20 microns, and, more preferably, less than about 15 microns; in the most preferred embodiment, the slurry in mill 46 is ground until at least 95 volume percent of the particles in the slurry have diameters less than about 5 microns. Additional liquid and/or dispersant can be added to mill 46 via line 59 if necessary.

A portion of the ground slurry from mill 46 is passed through a control circuit comprised of viscometer 50, density meter 52, particle size distribution analyzer 54, ph meter 53, and line 56, wherein the slurry is analyzed as described above for the slurry passing from line 28 into viscometer 30, density meter 32, ph meter 33, and particle size distribution analyzer 34. The feed to mill 46 can be adjusted, as required, by feeding crushed carbonaceous material from a dry grinding mill 24 and/or by adjusting the feeds to mill 26.

Slurry from density meter 52 is returned through line 56 to line 48. Part or all of ground slurry from mill 46 can be passed through lines 48, 58, and 60 back to mill 26, wherein it is fed as a recycle stream. Alternatively, or additionally, part or all of ground slurry from mill 46 can be passed via line 61 to mill 46 as a recycle stream. Alternatively, or additionally, part or all of ground slurry from mill 46 can be passed into high shear mixer 64. Any of the high shear, high intensity mixers known to those skilled in the art can be used as high shear mixer 64 and/or high shear mixer 86. Thus, by way of illustration and not limitation, one can use for the high shear mixer(s) a Banbury mixer, a Prodex-Henschel mixer, a Welex-Papenmeir mixer, and the like. These high-shear, intensive mixers are described on page 19–17 of Perry and Chilton's *Chemical Engineer's Handbook,* (McGraw Hill, New York, 1973), the disclosure of which is hereby incorporated by reference into this specification.

Dispersing agent is passed through line 62 to high shear mixer 64 to optimize the zeta potential of the colloidal particles of the slurry in the mixer. A sufficient amount of dispersing agent is charged to this mixer so that the final coal slurry product contains from about 0.01 to about 4.0 weight percent of dispersant, based on the weight of dry coal.

Some or all of the product from high shear mixer 64 can be recycled via lines 66 and 60 to ball mill 26, or via line 61 to mill 46. Alternatively or additionally, some or all of the product from high shear mixer 64 can be fed through line 68 to hopper 70 and thence to Moyno pump 74 for volumetric blending.

The "Moyno pump", also referred to as a "progressive cavity" or "moving cavity" pump, is well known to those skilled in the art. It consists of a convoluted hardened steel rotor and an inverse convoluted elastomeric stator so designed that as the rotor turns it maintains full contact with the stator on one side and only point to point contact with the stator on the other side. This produces a sealed cavity which moves in the direction of discharge as the rotor turns. Using a variable speed drive this pump can deliver variable volume flow rates at reasonable pressures and at high viscosities. Using a pair of pumps as 74 and 75 allows accurate blending volumetrically of two converging streams of fluids. This is described on pages 19-14 to 19-23 of Perry & Chilton's *Chemical Engineers Handbook,* 5th edition, *supra.*

The function of the Moyno pump in the process is to deliver the proper volumetric proportions of two streams from lines 68 and 42 or hoppers 70 and 72 to line 73 to low shear blender 76 via line 73. The blend from blender 76 is then transferred via line 77 using Moyno pump 78 through line 80 to a cleaning apparatus 82.

Material from Moyno pump 74 can be fed through line 73 to low shear blender 76. Any of the low shear blenders known to those skilled in the art can be used. Thus, by way of illustration and not limitation, one can use a twin-blade conical mixer (Atlantic Research Corp.), a double-arm kneader mixer (Baker Perkins Inc.), a helical ribbon mixer, gate mixers, Poly-Eon continuous reactors (Baker Perkins), the Rietz Extructor, Ko-Kneader (Baker Perkins), Transfer mix (Sterling Extruder Corp.), Rotofeed (Baker Perkins), ZSK (Werner-Pfleiderer), Halo-flite Processor (Joy Mfg. Co.), Kneadermaster (Patterson Industries Inc.), etc. Thereafter, the product from low shear blender 76 can be fed through line 77 to Moyno pump 78 and thence through line 80 to cleaner 82.

Cleaned slurry from cleaner 82 can be passed through line 83 to high shear mixer 86. Alternatively, or additionally, cleaner 82 can be bypassed in whole or in part and product from Moyno pump and/or mill 24 can be passed through lines 17 and 84 to high shear mixer 86. Required amounts of dispersant and liquid are fed in lines 88 and 90, respectively to the high shear mixer. A final control circuit, comprised of viscometer 94, density meter 96, line 92, particle size distribution analyzer 98, zeta meter 100, ash and sulfur analyzer 102 and ph meter 103, allows one to analyze a portion of the slurry being produced in high shear mixer 86 so that appropriate adjustments can be made in the feeds.

Any of the zeta meters known to those skilled in the art can be used as zeta meter 100. Similarly, any of the ash and sulfur analyzers known to those skilled in the art can be used as analyzer 102.

FIG. 2 also illustrates a dry grinding process for making the slurry of this invention. In this process, which may be used separately and/or in conjunction with the wet grinding process, crushed solid carbonaceous material from crusher 12 is passed through line 16 to dry grinder 24; part or all of the material from crusher 12 may alternatively be passed through transfer line 18 to be mixed with solid carbonaceous material from crusher 10 and thence passed through line 14 to mill 26. Any of the dry grinders known to those skilled in the art can be used as grinder 24. Thus, by way of illustration and not limitation, one can use a hammer mill. Thus, e.g., one can also use ball mills or the ring roller mills described on pages 8-33 and 8-34 of Perry and Chilton's *Chemical Engineer's Handbook,* 5th edition, *supra.* It is preferred to ground the crushed material in dry grinder 24 until it is pulverized, that is until it is a consist of about 40 mesh by 0.

The pulverized solid carbonaceous material from dry grinder 24 can be passed through line 44 to mill 46 wherein it may be mixed with the feed from line 29 (or, alternatively not mixed with any such additional feed) and thereafter processed as described hereinabove. Alternatively, or additionally, part or all of the pulverized material from dry grinder 24 can be passed through line 15 and line 14 to mill 26. Alternatively or additionally, part or all of the pulverized carbonaceous material from dry grinder 24 can be passed through line 17 and fed directly into high shear mixer 86, where it is blended with liquid and dispersant and ground to make carbonaceous material-liquid slurry.

In another embodiment, illustrated in FIG. 2, part or all of the underflow slurry which passes through sieve 38 can be passed through line 42 to hopper 72 and thence to Moyno pump 75. The product from Moyno pump 75 is then passed through line 73 to low shear blender 76 and processed as described above.

The operation of the control circuit comprised of viscometer 94, density meter 96, particle size distribution analyzer 98, zeta meter 100, and ash and sulfur analyzer 102 will now be described, it being understood that the other control circuits in the process operate in a similar manner.

In FIG. 2, control circuits are shown which are comprised of a viscometer, a densitometer, a particle size analyzer, and a pH meter. As will be apparent to those skilled in the art, fewer or more such control circuits can be used in the process, and the control circuits can be located at points in the process other than those indicated in FIG. 2.

A typical control circuit is comprised of viscometer 30, densitometer 32, particle size analyzer 34, and pH meter 33. This circuit continually monitors the viscosity, density, consist particle size distribution, and pH of the slurry, and it adjusts the process so that these factors are properly interrelated.

If the density of the slurry is not within the target range, or if the viscosity is too low, then the control circuit determines this and adjusts the ratio of the solids flow rate in the process to the liquids flow rate in the process, thereby adjusting the solids/liquids ratio.

If the viscosity of the slurry is higher than the target range, then the control circuit determines this and adjusts the dispersant concentration (insufficient dispersant can cause a viscosity increase), the solid and/or the liquid flow rate (an insufficient liquid flow rate will cause the solids/liquids ratio to be too high, and will thus cause the viscosity to increase), the pH (if the pH of the grinding mixture is too low, the viscosity might be too high), and/or the particle size distribution. The pH of the grinding mixture can be adjusted by adding more dispersant and/or caustic. It is to be understood that all of these factors are interrelated, and that the control circuit can, and preferably does, monitor and adjust all of these factors simultaneously.

For any given solids-slurry system, the target particle size distribution can be determined by analyzing "ideal" slurry and determining its particle size distribution; an "ideal" slurry is one which has the required solids content and viscosity and which fits into the equations described elsewhere in this specification. The particle size distribution of this "ideal slurry" can be determined on two Leeds and Northrup Microtrac Particle Analyzers-the Extended Range Analyzer (300–3 μm) and the Small Particle Analyzer (21–0.1 μm). The percent of the particles in the slurry consist which are less than 300 microns, 212 microns, 150 microns, 106 microns, 75 microns, 53 microns, 38 microns, 27 microns, etc. can be determined. Then, armed with this particle size profile for the ideal slurry, the particle size analyzer in the control circuit can continually analyze the particle size distribution of the slurry in the process and, if it is less than ideal, the control circuit can adjust the process accordingly. In general, the percent of the particles in the slurry consist which are less than a certain specified particle size can be adjusted by adjusting the relative feed rates of the solids and the liquids fed to the system. For example, if the particle size analyzer indicates that the percent of the particles in the consist less than 212 microns is not within the target range, this can be adjusted by varying the dry carbonaceous material feed rate. For another example, a change in the entire particle size distribution of the slurry consist, including the percent less than 212 μm, can be made by varying the solids/liquids ratio, i.e., by adjusting the volume percent solids in the grinding mixture.

Of particular importance in the particle size distribution analysis is the control of the "n" and the specific surface area of the slurry consist. The "n" in the particle size distribution equation is proportional to the difference between the weight percent concentrations of two selected channels in the Microtrac ER analyzer; the difference between the weight percent concentrations of, e.g., particles less than 150 microns and particles less than 53 microns can be determined for the aforementioned "ideal" slurry; and, armed with this "ideal difference" between said concentrations, the particle size analyzer can continually determine this difference for the slurry in the process and, if it varies from the ideal, the control circuit can adjust the relative feed rates of the solids and liquids fed to the system. The specific surface area of the consist in the slurry is proportional to the difference between the weight percent concentrations of two selected channels in the Microtrac SPA analyzer; the difference between the weight percent of, e.g., particles less than 1.01 and 0.34 microns can be determined for the aforementioned "ideal slurry"; and, armed with this "ideal difference", the particle size analyzer can continually determine this difference for the slurry in the process and, if it varies from the ideal, the control circuit can adjust the relative feed rates of the solids and liquids fed to the system.

The control system described in FIG. 2 is capable, thus, of continually monitoring and adjusting the slurry solids content, the slurry viscosity, the particle size distribution of the slurry consist, the "n" of the slurry consist, and the specific surface area of the slurry consist.

As indicated above, if the viscosity of the slurry is higher than the target rate, the control circuit determines this and can adjust the dispersant concentration and/or the solid flow rate and/or the liquid flow rate and/or the pH. Alternatively, or additionally, the control circuit can adjust the amount of reground carbonaceous fine material being recycled to the grinding mill; an insufficient amount of colloidally sized carbonaceous material in the slurry consist will cause the viscosity of the slurry to be too high, and the addition of finely ground carbonaceous material to such a slurry tends to reduce its viscosity. For example, if viscometer 30 determines that the slurry in mill 26 is too viscous, it can cause finely ground carbonaceous material from mill 46 and/or high shear mixer 64 to be recycled through line 60 to mill 26, thereby increasing the amount of fine material in the grinding mixture in mill 26 and tending to lower its viscosity. For example, if viscometer 94 determines that the slurry in high shear mixer 86 is too viscous, it can cause finely ground carbonaceous material from mill 46 and/or high shear mixer 64 to be recycled through line 60 to mill 26, thereby increasing the amount of fine material in the slurry ultimately fed to high shear mixer 86 through line 84; it can recycle finely ground carbonaceous material from mill 46 through lines 48, 58, 60, and 61 back into mill 46; it can recycle finely ground carbonaceous material from high shear mixer 64 through lines 66, 58 and 48 back into high shear mixer 64; it can recycle finely ground carbonaceous material from mill 26 through lines 28 and 40 back into mill 26; it can do any combination of the aforementioned steps; and the like. The aforementioned means of increasing the amount of finely ground carbonaceous material in mills 26 and 46 and mixers 64 and 86 are only illustrative, and those skilled in the art upon an examination of FIG. 2 will appreciate other means which can be used.

Thus the control circuit can adjust the viscosity of the slurry in mill 26 by adjusting the amount of carbonaceous material fed through line 14, the amount of carbonaceous material fed through lines 16 and 18, the amount of carbonaceous material fed through line 15, the amount of carrier liquid fed through line 20, the amount of dispersant fed through line 22, the amount of finely ground carbonaceous material recycled through lines 28 and 40, the amount of finely ground carbonaceous material recycled through lines 48, 58, and 60, the amount of finely ground carbonaceous material recycled through lines 66 and 60, and/or the pH. Thus, the control circuit can adjust the viscosity of the slurry in mill through lines 66 and 60, and/or the pH. Thus, the control 46 by adjusting any or all of the aforementioned factors influencing the slurry viscosity in mill 26, (for the properties of the slurry coming out of mill 26 influence the properties of the slurry formed in mill 46), and, additionally or alternatively, the amount of carbonaceous material fed to mill 46 through line 44, and the amount of carbonaceous material fed to mill 46 through line 29. Thus, the control circuit can adjust the viscosity of the slurry in high shear mixer 64 by adjusting any or all of the aforementioned factors influencing the slurry viscosity in mills 26 and 46 (for when the properties of these slurries are changed, they change the properties of the slurry in mixer 64) and, alternatively or additionally, the amount of dispersing agent added through line 62, and the amount of finely ground carbonaceous material recycled through lines 66 and 58 to mixer 64. Thus, the control circuit can adjust the viscosity of the slurry in high shear mixer 86 by adjusting any of the aforementioned factors influencing the slurry viscosity in mill 26, mill 46, and high shear mixer 64, and, alternatively or additionally, the amount of dispersing agent fed to mixer 86 through line 88, the amount of carrier liquid fed to mixer 86 through line 90, the amount of dry carbonaceous material fed to high shear mixer through line 17, the amount of finely ground carbonaceous material fed through line 42 to hopper 72, the pH of the slurry in mixer 86, and the like.

Cleaner 82, referred to in FIG. 2, can be any of the carbonaceous-slurry cleaning apparatuses known to those skilled in the art. Thus, by way of illustration and not limitation, one can use the electrophoretic deashing cell illustrated on page 3 (FIG. 3) of Miller and Baker's Bureau of Mines Report of Investigations 7960 (United States Department of the Interior, Bureau of Mines, 1974), the disclosure of which is hereby incorporated by reference into this specification. Thus, one can clean said slurry by passing it onto a sedimentation device, such as a lamella filter, where it is allowed to settle. Thus, one can effect magnetic separation of the slurry and/or combine such magnetic separation with sedimentation in the form of a pre- or post-treatment step.

In one preferred embodiment, cleaner 82 involves the cleaning process described in U.S. Pat. Nos. 4,186,887, and 4,173,530, the disclosures of which patents are hereby incorporated by reference into this application. In this preferred embodiment, it is preferred that no dispersing agent be added to the coal-fluid mixture until after the mixture has passed through cleaner 82 into high shear mixer 86, at which time the required amount of dispersant is added; thus, in this preferred embodiment, no dispersing agent is added to mill 26.

In one preferred embodiment, the carbonaceous solid material in the grinding mixture (and in the slurry produced therefrom) contains less than about 5 weight percent of ash. The term "ash", as used in this specification, includes non-carbonaceous impurities such as, e.g., inorganic sulfur, various metal sulfides, and other metal impurities as well as soil and clay particles. The fraction of ash in the carbonaceous material can be calculated by dividing the weight of all of the non-carbonaceous material in the slurry solids by the total weight of the slurry solids (which includes both carbonaceous and non-carbonaceous material).

It is preferred that the slurry produced by the process of this invention have a pH from about 5 to about 12 and, preferably, from about 7 to about 11. Conventional means may be used to adjust the pH of the slurry so that it is within these ranges.

In one preferred embodiment, the slurry produced by the process of this invention possesses a unique property; its viscosity decreases at a constant shear rate with time, at an increasing shear rate, and at an increasing temperature; this property greatly enhances the pumpability of the slurry.

In one embodiment, the slurry produced by the process of this invention is a yield-pseudoplastic fluid. The term "yield pseudoplastic fluid", as used in this specification, has the usual meaning associated with it in the field of fluid flow. Specifically, a yield pseudoplastic fluid is one which requires that a yield stress be exceeded before flow commences, and one whose apparent viscosity decreases with increasing rate of shear. In a shear stress vs. shear rate diagram, the curve for a yield pseudoplastic fluid shows a non-linearly increasing shear stress with a linearly increasing rate of shear. In a "pure" pseudoplastic system, no yield stress is observed so that the curve passes through the origin. However, most real systems do exhibit a yield stress, indicating some plasticity. For a yield pseudoplastic fluid, the viscosity decreases with increased shear rate.

In an even more preferred embodiment, the slurry produced by the process is also thixotropic, i.e., its viscosity decreases with time at a constant shear rate, Furthermore, in this embodiment, the slurry has a negative temperature coefficient of viscosity, i.e., its viscosity decreases with increasing temperature.

The following examples are presented to illustrate the claimed invention but are not to be deemed limitative thereof. Unless otherwise stated, all parts are by weight and all temperatures are in degree centigrade.

EXAMPLES

Example 1-Preparation of Coal Samples for Measurements (a) Sieve analysis

Although any standard procedure may be used to measure particle sizes of coal particles from a coal and then to calculate the particle size distribution, the procedure used in obtaining data discussed herein will be described.

A weighed sample, e.g. 50 grams dry wgt. of coal is dispersed in 400 m.l. of carrier water containing 1.0 wgt. % Lomar D based on a weight of coal, dry basis, and the slurry is mixed for 10 minutes with a Hamilton Beach mixer.

The sample is then remixed very briefly. It then is poured slowly on a stack of tared U.S. Standard sieves over a large vessel. The sample is carefully washed with running water through the top sieve with the rest of the stack intact until all sievable material on that sieve is washed through the sieve into the underlying sieves. The top sieve is then removed and each sieve in the stack, as it becomes the top sieve, is successively washed and removed until each sieve has been washed. The sieves are then dried in a dryer at 105° C. and the residue on each is weighed in a known way.

(b) Sedigraph analysis

A separate sample finer than 140 mesh sieve size is carefully stirred and a representative sample (about 200 m.l.) is taken for analysis. The rest may be discarded.

About 2 eyedroppers of the dilute slurry are further diluted in 30 m.l. of distilled water with 4 drops of Lomar D added. This sample is stirred overnight with a magnetic stirrer. Measurement is then made with the Sedigraph 5500L.

The Sedigraph 5500L uses photo extinction to measure particles. It essentially measures projected area of shadows, and the data must be converted to volume-%-finer-than. The data from the sieve and Sedigraph is combined to prepare a CPFT chart. $D_s$ at 1% is read from the CPFT line.

Example 2-Preparation of coal/water slurry

Three hundred thirty-five pounds of 4×0 Ohio No. 6 bituminous coal with a Hardgrove Grindability Index (HGI) of 50 and a free swelling index (FSI) of 3.5, 6.0 pounds of water, 0.1 weight % (0.1 weight %) of sodium hydroxide, and 1.1 wgt. %, (1673 grams) of Lomar D® (the sodium salt of a condensed alkyl mononaphthalene sulfonic acid sold by the Diamond Shamrock Process Chemicals, Inc. of Morristown, N.J.) where charged in a Kennedy Van Saun 3 foot diameter×5 foot long ball mill (manufactured by the Kennedy Van Saun Co. of Danville, Pa.). The ball mill had 35 volume % of a 2.0 inch top Bond ball charge and was comprised of 34 weight % of balls of 2.0 inch diameter, 43 weight % of balls of 1.5 inch diameter, 17 weight % of balls of 1.25 inch diameter, and 6 weight % of balls of 1.0 inch diameter.

The ball mill was run at a speed of 33 revolutions per minute, which corresponded to 70 percent of the critical speed of the ball mill. Grinding was conducted in the mill under these conditions until about 98.5 weight percent of the coal particles passed through a 50 mesh screen; during the grinding, samples of the slurry were periodically evaluated to determine the fineness of the coal in the slurry.

In substantial accordance with the procedure of Example 1, the particle size distribution of the slurry produced in the ball mill were determined by sieve analysis and by Sedigraph 5500L analysis. The sieve analysis indicated the amount of coal particles in the slurry consist which ranged from about 53 microns (270 mesh) to the largest size coal particle in the slurry (about 1180 microns). The Sedigraph analysis indicated the amount of coal particles in the slurry consist which ranged from about 74 microns to the smallest size coal particle in the slurry which was present in a concentration of at least 1 weight percent. The sieve analysis data and the Sedigraph analysis data were then merged to yield the volume percent of the various sized particles in the slurry. Thereafter, based upon the assumption that all of the particles in the slurry were spherical, the specific surface area and the porosity of the coal particles in the slurry consist were calculated.

The slurry consist of this Example 2 had a porosity of 8.096 volume percent and a specific surface area of 1.015 $m^2/cc^3$. This slurry produced a yield stress of about 1.0–2.0 Pascals at 70 volume solids and was unstable. The slurry had a Haake viscosity of 2500 cps at 100 $sec^{-1}$.

Portions of unstable slurry produced in substantial accordance with this Example 2 were diluted to concentrations of either 40 weight percent, 50 weight percent, or 60 weight percent, and each of these diluted portions was separately ground in a Draiswerke stirred ball mill (model number PM 25-40 STS/DDA, manufactured by Draiswerke Inc. of Allendale, N.J.). The 40 percent samples were fed to the ball mill at a feed rate of 100 pounds per hour; the 50 percent samples were fed at a rate of 300 pounds hour; the 60 percent samples were fed at a rate of 450 pounds per hour. The ball mill was run at an internal shaft speed of 520 r.p.m. The grinding media were 2 m.m. diameter steel balls. The product produced by the grinding at 40% solids in the Draiswerke stirred ball mill had a $D_L$ of 64 μm and a median size of 21.6 μm; the surface area was 5.582 $m^2/cm^3$, and the porosity was 19.44 percent. The product produced by grinding at 50% solids in the Draiswerke stirred ball mill had a $D_L$ of 9.3 μm and a median size of 2.561 μm; the surface area was 3.962 $m^2/cm^3$, and the porosity was 16.85 percent. The product by grinding at 60% solids in the Draiswerke stirred ball mill had a $D_L$ of 19.6 μm and a median size of 4.766 μm; the surface area was 2.639 $m^2/cm^3$, and the porosity was 12.69 volume percent.

The procedure of Example 2 was repeated with the exception that a different charge was put in an Abbe ball mill instead of a Kennedy Van Saun ball mill. The Abbe ball mill was model Double No. 2, manufactured by the Paul O. Abbe Company of Little Falls, N.J.; it had 35% volume of 2.0 inch top Bond ball size and was run at a speed of 34 revolutions per minute, which corresponded to 51 percent of the ball mill critical speed. Instead of using 100 weight percent of dry Ohio No. 6 bituminous coal, the charge now contained either 5 weight percent, 10 weight percent, or 15 weight percent of one of the reground coals produced in the Draiswerke stirred ball mill (by weight of coal). The dry coal/slurry/water/surfactant mixture was then ground in the Abbe ball mill in accordance with the procedure of this Example 2, but the surfactant concentration in the mixture was still 1.1 weight percent (no surfactant or caustic was added when the fine portions were ground).

The properties of the slurries obtained are indicated below in Table 1.

TABLE 1

| # weight slurry added to Abbe mill | % type fines added | Volume percent solids | Porosity % | Surf. area $m^2/cm^3$ | Bingham viscos. cP | Zeta pot. mV |
|---|---|---|---|---|---|---|
| 0 | | 64 | 7.3 | 0.96 | 1300 | −43.36 |
| 5A | 40% | 64 | 6.90 | 1.16 | 1500 | −42.67 |
| 10A | 40% | 64 | 10.97 | 1.2 | 1250 | −42.29 |
| 15A | 40% | 64 | 6.21 | 1.80 | 1850 | −44.59 |
| 5B | 50% | 64 | 7.47 | 1.08 | 1800 | −38.57 |
| 10B | 50% | 64 | 6.43 | 1.38 | 1150 | −40.53 |
| 15B | 50% | 64 | 6.68 | 1.38 | 1700 | −40.78 |
| 5C | 60% | 64 | 9.30 | 0.97 | 1350 | −33.94 |
| 10C | 60% | 64 | 6.30 | 1.02 | 1850 | −44.13 |
| 15C | 60% | 64 | 4.99 | 1.18 | 1200 | −41.52 |

Example 3—Preparation of coal/water slurry

A coal mixture comprised of a blend of coal from Virginia, Kentucky, and West Virginia was used; this coal was supplied by the United Coal Company of Bristol, Va., it had a Hardgrove grindability index of about 50, it had a volatile content (dry basis) of 42.25 percent, and it contained 1.66 weight percent of ash (on a dry basis).

A 7.23 pound portion of this coal together with 3.23 pounds of water were charged in an 8.0 inch diameter steel ball mill with ½ inch steel balls. Grinding was conducted at 50 percent ball charge loading at about 50 RPM for about 20 hours. The ground coal produced in this ball mill was 99.5% > 11.9 μm, with a median size of 8.23 μm. The surface area was 1.48 $m^2/cm^3$, and porosity was 12.31 percent.

A 13.85 pound sample of this coal was crushed in a roll crusher to a 4×0 mesh consist. The crushed coal was then charged to a 16.0 inch diameter Abbe mill with 2 inch top Bond ball charge together with the 4.60 pounds of the fine coal slurry produced in the 8.0 inch diameter mill, 3.28 pounds of water, 7.4 grams of caustic, and 51.8 grams of Lomar ®D. This mixture was ground until the mixture contained at least about 98.5 percent of the coal particles contained at least about 98.5 percent of the coal particles which passed through a 50 mesh screen. The coal slurry thus produced contained no more than about 1.66 weight percent of ash (dry basis). The slurry had a viscosity of about 1030 centipoise at 71 weight percent solids at 100 $sec^{-1}$. Particle size analysis of the coal consist of the slurry indicated that the consist had a porosity of 5.11 percent, and a specific surface area of 0.94 $m^2/cm^3$.

It is to be understood that the foregoing description and Examples are illustrative only and that changes can be made in the ingredients and their proportions and in the sequence and combination of process steps as well as other aspects of the invention discussed without departing from the scope and spirit of the invention as defined in the following claims.

I claim:

1. A grinding mixture comprising from about 60 to about 82 volume percent of solid carbonaceous material, from about 18 to about 40 volume percent of carrier liquid, and from about 0.01 to about 4.0 weight percent, by weight of dry solid carbonaceous material, of dispersing agent, wherein:

(a) said grinding mixture has a pH of from about 5 to about 12, (b) said grinding mixture contains at least two consists of solid carbonaceous material, (c) from about 2 to about 50 weight percent of said solid carbonaceous material is comprised of carbonaceous particles with a median particle size of from about 0.05 to about 40 microns, and (d) from about 50 to about 98 weight percent of said solid carbonaceous material is comprised of carbonaceous particles with a median particle size greater than about 40 microns.

2. The grinding mixture as recited in claim 1, wherein said solid carbonaceous material is a solid carbonaceous fuel.

3. The grinding mixture as recited in claim 1, wherein said carbonaceous material is selected from the group consisting of coal, coke, char, charcoal, and mixtures thereof.

4. The grinding mixture as recited in claim 3, wherein said carbonaceous material is coal.

5. The grinding mixture as recited in claim 3, wherein said carbonaceous material is coke.

6. The grinding mixture as recited in claim 1, wherein from about 4 to about 40 weight percent of the solid carbonaceous material in the grinding mixture is comprised of carbonaceous particles with a median particle size of from about 1 to about 30 microns.

7. The grinding mixture as recited in claim 1, wherein from about 60 to about 96 weight percent of said solid carbonaceous material is comprised of carbonaceous particles with a median particle size greater than about 40 microns.

8. The grinding mixture as recited in claim 1, wherein from about 6 to about 30 weight percent of the solid carbonaceous material in the grinding mixture is comprised of carbonaceous particles with a median particle size of from about 2 to about 20 microns.

9. The grinding mixture as recited in claim 1, wherein from about 70 to about 94 weight percent of said solid carbonaceous material is comprised of carbonaceous particles with a median particle size greater than about 40 microns.

10. The grinding mixture as recited in claim 1, wherein the pH of said grinding mixture is from about 7 to about 11.

11. The grinding mixture as recited in claim 1, wherein said grinding mixture comprises from about 64 to about 81 volume percent of solid carbonaceous material.

12. The grinding mixture as recited in claim 11, wherein said grinding mixture comprises from about 75 to about 80 volume percent of solid carbonaceous material.

13. The grinding mixture as recited in claim 1, wherein said liquid is water.

14. The grinding mixture as recited in claim 1, wherein said liquid is a petroleum liquid selected from the group consisting of number 2 fuel oil, number 4 fuel oil, number 6 fuel oil, gasoline, naphtha, and mixtures thereof.

15. The grinding mixture as recited in claim 1, wherein said liquid is a mixture of water and petroleum liquid.

16. The grinding mixture as recited in claim 15, wherein at least 90 weight percent of said carrier liquid is water and no more than about 10 weight percent of said carrier liquid is a petroleum liquid.

17. The grinding mixture as recited in claim 2, wherein said carbonaceous material is selected from the group consisting of coal, coke, char, charcoal, and mixtures thereof.

18. The grinding mixture as recited in claim 17, wherein said grinding mixture comprises from about 64 to about 81 volume percent of solid carbonaceous material.

19. The grinding mixture as recited in claim 18, wherein from about 4 to about 40 weight percent of the solid carbonaceous material in the grinding mixture is comprised of carbonaceous particles with a median particle size of from about 1 to about 30 microns.

20. The grinding mixture as recited in claim 19, wherein from about 60 to about 96 weight percent of said solid carbonaceous material is comprised of carbonaceous particles with a median particle size greater than about 40 microns.

21. The grinding mixture as recited in claim 20, wherein the pH of said grinding mixture is from about 7 to about 11.

22. A process of preparing a solid-liquid slurry, comprising the steps of:

(a) providing the grinding mixture of claim 1; and (b) grinding said mixture until a solid-liquid slurry is produced wherein:

1. said slurry is comprised of from about 60 to about 82 volume percent of solid carbonaceous material, from about 18 to about 40 volume percent of carrier liquid, and from about 0.01 to about 4.0 weight percent, by weight of dry carbonaceous material, of dispersing agent;
2. said slurry has a yield stress of from about 3 to about 18 Pascals and a Brookfield viscosity at a solids content of 70 volume percent, ambient temperature, ambient pressure, and a shear rate of 100 revolutions per minute of less than 5,000 centipoise;
3. the slurry consist has a specific surface area of from about 0.8 to about 4.0 square meters per cubic centimeter and an interstitial porosity of less than 20 volume percent;
4. from about 5 to about 70 volume percent of said particles of solid carbonaceous material are of colloidal size, being smaller than about 3 microns;
5. said slurry consists of finely-divided particles of solid carbonaceous material has a particle size distribution substantially in accordance with the following formula:

$$\frac{CPFT}{100} = \sum_{j=1}^{k} \left[ X_j \left( \frac{D^{Nj} - D_{sj}^{Nj}}{D_{Lj}^{Nj} - D_{sj}^{Nj}} \right) \right]$$

where $\sum_{j=1}^{k} X_j = 1.0$ and where if $D < D_{sj}$ $\left( \frac{D^{Nj} - D_{sj}^{Nj}}{D_{Lj}^{Nj} - D_{sj}^{Nj}} \right) = 0.0$ -continued $$\text{and where if } D > D_{Lj} \left( \frac{D^{Nj} - D_{sj}^{Nj}}{D_{Lj}^{Nj} - D_{sj}^{Nj}} \right) = 1.0$$

wherein:

(a) CPFT is the cumulative percent of said solid carbonaceous material finer than a certain specified particle size D, in volume percent;

(b) k is the number of component distributions in the consist and is at least 1;

(c) $X_j$ is the fractional amount of the component j in the consist, is less than or equal to 1.0, and the sum of all of the $X_j$'s in the consist is 1.0;

(d) n is the distribution modulus of fraction j and is greater than about 0.001;

(e) D is the diameter of any particle in the consist and ranges from about 0.05 to about 1180 microns;

(f) $D_s$ is the diameter of the particle in fraction j, measured at 1% CPFT on a plot of CPFT versus size D, is less then $D_L$, and is greater than 0.05 microns;

(g) $D_L$ is the diameter of the size modulus in fraction j, measured by sieve size or its equivalent, and is from about 10 to about 1180 microns; and (h) no more than about 0.05 volume percent of the particles in the slurry consist have a diameter less than about 0.05 microns;

6. the net zeta potential of said colloidal size particles of solid carbonaceous material is from about 15 to about 85 millivolts; and 7. the concentration of solid carbonaceous material in said slurry, the interstitial porosity of said consist, the specific surface area of said consist; and the zeta potential of said colloidal size particles of solid carbonaceous material are interrelated in accordance with the following formula:

$$V_s + P_s + SA + 240/ZP = H$$

wherein:

(a) $V_s$ is the percent, by volume, of solid carbonaceous material in said slurry;

(b) P is the porosity of said consist in the slurry, in percent;

(c) S.A. is the specific surface area consist in said slurry, in square meters per cubic centimeter;

(d) Z.P. is the net zeta potential of said colloidal size particles of carbonaceous material in said consist, in millivolts, and (e) H is from about 75 to about 98.

23. The process as recited in claim 22, wherein said solid carbonaceous material is coal.

24. The process as recited in claim 22, wherein said solid carbonaceous material is coke.

25. The process as recited in claim 24, wherein said coke is petroleum coke.

26. The process as recited in claim 22, wherein said solid carbonaceous material is char.

27. The process as recited in claim 22, wherein said solid carbonaceous material is charcoal.

28. The process as recited in claim 22, wherein said solid carbonaceous material is solvent refined coal.

29. The process as recited in claim 22, wherein said solid carbonaceous material comprises a mixture of at least one coarse carbonaceous fraction containing less than about 30 weight percent of volatilizable hydrocarbons and at least one fine carbonaceous fraction which contains more than about 35 weight percent of volatilizable hydrocarbons.

30. The process as recited in claim 22, wherein from about 4 to about 40 weight percent of said solid carbonaceous material in said grinding mixture has a median particle size of from about 1 to about 30 microns.

31. The process as recited in claim 30, wherein from about 6 to about 30 weight percent of said solid carbonaceous material in said grinding mixture has a median particle size of from about 2 to about 20 microns.

32. The process as recited in claim 29, wherein said grinding mixture is comprised of from about 60 to about 96 weight percent of coarse solid carbonaceous material which has a median particle size greater than about 40 microns.

33. The process as recited in claim 30, wherein said grinding mixture is comprised of from about 70 to about 94 weight percent of coarse solid carbonaceous material which has a median particle size greater than about 40 microns.

34. The process as recited in claim 22, wherein said grinding mixture is comprised of from about 64 to about 81 volume percent of said solid carbonaceous material.

35. The process as recited in claim 34, wherein said grinding mixture is comprised of from about 75 to about 80 volume percent of said solid carbonaceous material.

36. The process as recited in claim 22, wherein the pH of said grinding mixture is from about 7 to about 11.

37. The process as recited in claim 22, wherein said liquid is an alcohol containing from about 1 to about 10 carbon atoms.

38. The process as recited in claim 37, wherein said alcohol is selected from the group consisting of methanol, ethanol, propanol, butanol, phenol, and mixtures thereof.

39. The process as recited in claim 22, wherein said liquid is petroleum liquid.

40. The process as recited in claim 39, wherein said petroleum liquid is selected from the group consisting of number 2 fuel oil, number 4 fuel oil, number 6 fuel oil, gasoline, nephtha, and mixtures thereof.

41. The process as recited in claim 22, wherein said liquid is carrier water.

42. The process as recited in claim 22, wherein said liquid comprises a mixture of at least two liquids.

43. The process as recited in claim 42, wherein said liquid comprises a mixture of water and an alcohol containing from about 1 to about 10 carbon atoms.

44. The process as recited in claim 43, wherein said alcohol is ethanol.

45. The process as recited in claim 42, wherein said liquid comprises a mixture of water and petroleum liquid.

46. The process as recited in claim 45, wherein at least about 90 weight percent of said liquid is water and less than about 10 weight percent of said liquid is petroleum liquid.

47. The process as recited in claim 22, wherein said grinding mixture comprises from about 19 to about 36 volume percent of carrier liquid.

48. The process as recited in claim 47, wherein said grinding mixture comprises from about 20 to about 25 volume percent of carrier liquid.

49. The process as recited in claim 22, wherein said slurry has a yield stress of from about 5 to about 15 Pascals.

50. The process as recited in claim 49, wherein said slurry has a yield stress of from about 7 to about 12 Pascals.

51. The process as recited in claim 22, wherein said Brookfield viscosity of said slurry is less than 4,000 centipoise.

52. The process as recited in claim 51, wherein said Brookfield viscosity of said slurry is less than 3,000 centipoise.

53. The process as recited in claim 52, wherein said Brookfield viscosity of said slurry is less than 2,000 centipoise.

54. The process as recited in claim 53, wherein said Brookfield viscosity of said slurry is less than 1,000 centipoise.

55. The process as recited in claim 22, wherein said slurry consist has a specific surface area of from about 0.8 to about 3.0 square meters per cubic centimeter.

56. The process as recited in claim 55, wherein said slurry consist has a specific surface area of from about 0.8 to about 2.4 square meters per cubic centimeter.

57. The process as recited in claim 56, wherein said slurry consist has a specific surface area of from about 0.8 to about 2.0 square meters per cubic centimeter.

58. The process as recited in claim 22, wherein said slurry consist has an interstitial porosity of less than about 15 volume percent.

59. The process as recited in claim 58, wherein said slurry consist has an interstitial porosity of less than about 10 volume percent.

60. The process as recited in claim 22, wherein from about 5 to about 30 weight of the carbonaceous particles in said slurry consist are smaller than 3.0 microns.

61. The process as recited in claim 22, wherein said k is from about 1 to about 30.

62. The process as recited in claim 61, wherein said k is 1.

63. The process as recited in claim 22, wherein said n is from about 0.001 to about 10.

64. The process as recited in claim 63, wherein said n is from about 0.01 to about 1.0.

65. The process as recited in claim 64, wherein said n is from about 0.1 to about 0.5.

66. The process as recited in claim 22, wherein said $D_L$ is from about 30 to about 420 microns.

67. The process as recited in claim 22, wherein at least 90 weight percent of the solid carbonaceous particles in said slurry have a particle size less than 300 microns.

68. The process as recited in claim 67, wherein at least 95 weight percent of the solid carbonaceous particles in said slurry have a particle size less than 300 microns.

69. The process as recited in claim 41, wherein the colloidal sized carbonaceous particles in said slurry have a net zeta potential of from about 15 to about 85 millivolts.

70. The process as recited in claim 41, wherein the colloidal sized carbonaceous particles in said slurry have a zeta potential of from about −15.4 to about −70.2 millivolts.

71. The process as recited in claim 70, wherein the colloidal sized carbonaceous particles in said slurry have a zeta potential of from about −30 to about −70 millivolts.

72. The process as recited in claim 22, wherein said grinding mixture is ground in a tumbling mill.

73. The process as recited in claim 72, wherein said tumbling mill is a ball mill.

74. The process as recited in claim 73, wherein said grinding mixture is ground at from about 50 to about 70 percent of the ball mill critical speed.

75. The process as recited in claim 74, wherein said grinding mixture is ground at less than about 60 percent of the ball mill critical speed.

76. The process as recited in claim 75, wherein said grinding mixture is ground at less than about 55 percent of the ball mill critical speed.

77. The process as recited in claim 22, wherein:

(a) from about 4 to about 40 weight percent of said solid carbonaceous material in said grinding mixture has a median particle size of from about 1 to about 30 microns;

(b) said grinding mixture is comprised of from about 60 to about 96 weight percent of coarse solid carbonaceous material which has a median particle size greater than about 40 microns;

(c) said grinding mixture is comprised of from about 64 to about 81 volume percent of said solid carbonaceous material;

(d) the pH of said grinding mixture is from about 7 to about 11;

(e) said grinding mixture comprises from about 19 to about 36 volume percent of carrier liquid;

(f) said slurry has a yield stress of from about 5 to about 15 Pascals;

(g) said Brookfield viscosity of said slurry is less than 3,000 centipoise;

(h) said slurry consist has a specific surface area of from about 0.8 to about 3.0 square meters per cubic centimeter;

(i) said slurry consist has an interstitial porosity of less than about 15 volume percent;

(j) from about 5 to about 30 weight of the carbonaceous particles in said slurry consist are smaller than 3.0 microns;

(k) said k is 1;

(l) said n is from about 0.01 to about 1.0.

78. The process as recited in claim 77, wherein:

(a) from about 6 to about 30 weight percent of said solid carbonaceous material in said grinding mixture has a median particle size of from about 2 to about 20 microns;

(b) said grinding mixture is comprised of from about 70 to about 94 weight percent of coarse solid carbonaceous material which has a median particle size greater than about 40 microns;

(c) said slurry has a yield stress of from about 7 to about 12 Pascals;

(d) said Brookfield viscosity of said slurry is less than 2,000 centipoise;

(e) said slurry consist has a specific surface area of from about 0.8 to about 2.4 square meters per cubic centimeter;

(f) said n is from about 0.1 to about 0.5.

79. The process as recited in claim 78, wherein:

(a) said solid carbonaceous material is coal;

(b) said liquid is carrier water; and (c) the colloidal sized coal particles in the slurry have a net zeta potential of from about 15 to about 85 millivolts.

80. The process as recited in claim 79, wherein the colloidal sized coal particles in the slurry have a zeta potential of from about −15.4 to about −70.2 millivolts.

81. The process as recited in claim 79, wherein the colloidal sized coal particles in said slurry have a zeta potential of from about −30 to about −70 millivolts.

82. The process as recited in claim 78, wherein:
(a) said solid carbonaceous material is coke; and
(b) said liquid is petroleum liquid.

83. The process as recited in claim 82, wherein:
(a) said coke is petroleum coke; and
(b) said petroleum liquid is selected from the group consisting of number 2 fuel oil, number 4 fuel oil, number 6 fuel oil, gasoline, naphtha, and mixtures thereof.

84. The process as recited in claim 78, wherein said liquid comprises a mixture of water and petroleum liquid.

85. The process as recited in claim 84, wherein at least about 90 weight percent of said liquid is water and less than about 10 weight percent of said liquid is petroleum liquid.

86. The process as recited in claim 78, wherein said grinding mixture is ground in a tumbling mill.

87. The process as recited in claim 86, wherein said tumbling mill is a ball mill.

88. The process as recited in claim 87, wherein said grinding mixture is ground at from about 50 to about 70 percent of the ball mill critical speed.

89. The process as recited in claim 88, wherein said grinding mixture is ground at less than about 60 percent of the ball mill critical speed.

90. The process as recited in claim 89, wherein said grinding mixture is ground at less than about 55 percent of the ball mill critical speed.

91. The process as recited in claim 78, wherein:
(a) said grinding mixture is comprised of from about 75 to about 80 volume percent of said solid carbonaceous material;
(b) said grinding mixture comprises from about 20 to about 25 volume percent of carrier liquid;
(c) said slurry consist has a specific surface area of from about 0.8 to about 2.0 square meters per cubic centimeters; and
(d) said slurry consist has an interstitial porosity of less than about 10 volume percent.

92. The process as recited in claim 78, wherein said Brookfield viscosity of said slurry is less than 1,000 centipoise.

* * * * *